US005776670A

United States Patent [19]

Uchida

[11] Patent Number: 5,776,670

[45] Date of Patent: *Jul. 7, 1998

[54] SILVER HALIDE PHOTOGRAPHIC LIGHT-SENSITIVE MATERIAL

[75] Inventor: Mitsuhiro Uchida, Minami-ashigara, Japan

[73] Assignee: Fuji Photo Film Co., Ltd., Kanagawa, Japan

[ * ] Notice: The term of this patent shall not extend beyond the expiration date of Pat. No. 5,405,738.

[21] Appl. No.: 796,475

[22] Filed: Feb. 10, 1997

Related U.S. Application Data

[63] Continuation of Ser. No. 631,826, Apr. 10, 1996, abandoned, which is a continuation of Ser. No. 351,150, Nov. 30, 1994, abandoned, which is a continuation of Ser. No. 84,995, Jul. 2, 1993, abandoned.

[30] Foreign Application Priority Data

Jul. 6, 1992 [JP] Japan ..... 4-200163

[51] Int. Cl.[6] ..... G03C 1/035; G03C 1/34

[52] U.S. Cl. ..... 430/567; 430/570; 430/614; 430/627

[58] Field of Search ..... 430/567, 614, 430/627, 570

[56] References Cited

U.S. PATENT DOCUMENTS

| | | | |
|---|---|---|---|
| 4,874,687 | 10/1989 | Itabashi | 430/567 |
| 5,132,201 | 7/1992 | Yagihara et al. | 430/264 |
| 5,187,058 | 2/1993 | Inou | 430/567 |
| 5,264,338 | 11/1993 | Urabe et al. | 430/569 |
| 5,405,738 | 4/1995 | Uchida | 430/567 |

*Primary Examiner*—Thorl Chea

*Attorney, Agent, or Firm*—Sughrue, Mion, Zinn, Macpeak & Seas, PLLC

[57] ABSTRACT

A silver halide photographic light-sensitive material has at least one silver halide emulsion layer on a support, and contains an imidazole compound. The silver halide emulsion layer contains substantially perfect cubic grains.

9 Claims, 1 Drawing Sheet

$$S1 = Sa + Sb + Sc + Sd + S2$$

$$S1 = Sa + Sb + Sc + Sd + S2$$

SILVER HALIDE PHOTOGRAPHIC LIGHT-SENSITIVE MATERIAL

This is a Continuation of application Ser. No. 08/631,826, filed Apr. 10, 1996, now abandoned, which is Continuation of application Ser. No. 08/351,150, filed Nov. 30, 1994, now abandoned, which is a Continuation of application Ser. No. 08/084,995, filed Jul. 2, 1993, now abandoned.

BACKGROUND OF THE INVENTION

1. Field of the Invention

The present invention relates to a silver halide photographic light-sensitive material which uses a silver halide emulsion having a high sensitivity and an improved graininess and also excellent in saving of silver because of a high color density and hard gradation photographic properties, and which is high in sensitivity when high illumination intensity exposure is performed.

2. Description of the Related Art

Emulsions having various outer shapes are known as silver halide emulsions constituting silver halide photographic light-sensitive materials. Examples are regular crystal emulsions containing, e.g., cubic, octahedral, tetradecahedral, and rhomboid dodecahedral grains, and twinned crystal emulsions including double twinned crystals, such as tabular grains.

Among these emulsions, tabular grains which are twined crystal emulsions have characteristics that light scattering is small owing to their outer shapes, a large amount of sensitizing dyes can be used because their specific surface areas are large, resulting in a high spectral sensitization efficiency. The characteristic features of the regular crystal emulsions, on the other hand, which are derived from their isotropic structures, are that formation of grains with, e.g., a multiple structure can be performed easily in accordance with the intended use, the emulsions can be monodispersed relatively easily, and spectral sensitization and chemical sensitization can be performed uniformly between grains. Therefore, the regular crystal emulsions are suitable for the purpose of providing hard-contrast emulsions with high color densities by increasing quantum sensitivities of the emulsions.

Representative examples of the regular crystal emulsions are a cubic emulsion whose surface is constituted by (100) faces and an octahedral emulsion whose surface is constituted by (111) faces. A variety of basic researches have long been made on these two types of emulsions. For example, as Tani describes in Photogr. Sci. Eng. 18:215–225 (1974), it is known that the intrinsic desensitization of the cubic emulsion with the (100) faces is smaller than that of the octahedral emulsion when sensitizing dyes are adsorbed. It is, therefore, considered that the cubic emulsion is superior to the octahedral emulsion as a spectrally sensitized emulsion.

It is known that the cubic emulsion can be easily formed with a silver halide primarily consisting of silver chloride. The manufacture of the cubic emulsion, however, is not necessarily easy with silver bromochloroiodide having a silver chloride content of 3 mol % or less, which is mainly used in high-sensitivity color photographic light-sensitive materials; the manufacture requires grain formation at a low pAg, that is difficult to control. If a silver halide solvent, such as ammonia, is used, the cubic emulsion can be formed even at a relatively high pAg. However, the presence of the solvent causes dissolution of the corners or the edges of grains to make it difficult to form a perfect cubic emulsion. On the other hand, when grain formation is performed at a low pAg or in the presence of ammonia, reducing silver nuclei are formed in each silver halide grain. This sometimes results in undesirable photographic properties, such as production of fog. U.S. Pat. No. 3,655,394 discloses a method of manufacturing a cubic emulsion at a low pH and a relatively high pAg, under which conditions reducing silver nuclei are hard to form. In addition, JP-B-53-17492 ("JP-B" means Published Examined Japanese Patent Application), JP-B-57-56055, JP-B-60-35055, JP-A-62-115155 ("JP-A" means Published Unexamined Japanese Patent Application), JP-A-62-13250, and JP-A-2-87136 describe that a cubic emulsion can be manufactured at a high pAg, or a sensitizing effect can be obtained, when a specific compound is used together with the cubic emulsion. Although, however, a large number of studies have been made on formation of cubic grains as described above, none of them completely solves the above problems.

In contrast, JP-A-62-229132 describes a cubic or tetradecahedral grain whose corners are rounded. When the present inventor performed supplementary tests, however, it was found that the sensitizing effect was obtained not by the rounded corners but by compounds which were added in order to round the corners.

Various studies have been made on the cubic emulsions as described above, but only few examples demonstrate the use of the emulsions in color photographic light-sensitive materials: the examples are some color negative films available from Eastman Kodak Co., Ltd., and motion-picture intermediate films available from Eastman Kodak Co., Ltd. and Fuji Photo Film Co., Ltd.

According to the supplementary tests conducted on the patents described above by the present inventor, it was found that although nearly perfectly cubic grains could be made immediately after grain formation in some cases, those obtained through desalting and chemical sensitization, that were necessary in increasing the sensitivity, were all cubic grains whose corners were chipped off. The present inventor has made further investigation but found no superiority of this imperfect cubic grain with chipped corners or edges to an octahedral emulsion and a tabular grain.

Moreover, silver halide color photographic light-sensitive materials have been recently required to have higher sensitivities and higher image qualities. In addition, for the purposes of saving resources, reducing cost, and decreasing quantities of replenishers of processing solutions, a strong demand has arisen for development of a silver halide color photographic light-sensitive material which can achieve a high color density even with a small silver amount without impairing image qualities, such as graininess.

Under the circumstances, the present inventor has found that it is possible to provide a silver halide photographic light-sensitive material with a high contrast, a high color density, and a good graininess by the use of a perfect cubic emulsion. This emulsion, however, is low in sensitivity when high illumination intensity exposure is performed.

Recently, photographs are more often taken with the use of electronic flashes. Therefore, a demand has arisen for improvements not only in image quality for a normal exposure time of about 1/100 second but in image quality when high illumination intensity exposure with a short exposure time is performed.

A known means of improving the sensitivity at high illumination intensity is to add an iridium compound during grain formation, or during or after chemical sensitization. The sensitivity at high illumination intensity, however, is still insufficient even by the use of this method, and the method has another drawback of a decrease in sensitivity when exposure of about 1/100 second is performed.

SUMMARY OF THE INVENTION

It is an object of the present invention to provide a silver halide photographic light-sensitive material, with a high sensitivity, a hard contrast, a high color density, a good graininess, and a high sensitivity at high illumination intensity, improved in image quality, silver saving, and image quality upon high illumination intensity exposure.

The present inventor has considered that a cubic emulsion having the characteristics as described above is suitable for the above object, and achieved the object by the present invention specified below, as a result of extensive studies.

The present invention provides a silver halide photographic light-sensitive material comprising at least one silver halide emulsion layer on a support, and containing an imidazole compound, the silver halide emulsion layer containing substantially perfect cubic silver halide grains.

In one embodiment, the imidazole compound may be represented by Formula I below:

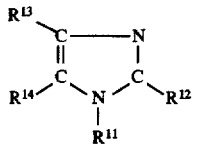

Formula I where $R^{11}$, $R^{12}$, $R^{13}$, and $R^{14}$ may be the same or different and each represents a hydrogen atom, or an alkyl group, an alkenyl group, and aryl group or an aralkyl group, each of which group is either unsubstituted or substituted with at least one member selected from the group consisting of hydroxyl, cyano, alkoxy, and free or esterified carboxyl or sulfo.

Alternatively, the imidazole compound contained in the silver halide photographic light-sensitive material of the invention may also be represented by Formula II below:

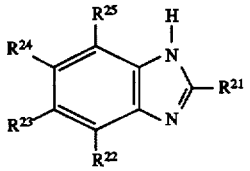

Formula II where $R^{21}$ represents a hydrogen atom, a halogen atom, an alkyl group, an alkenyl group, an aryl group, or a heterocyclic group; and $R^{22}$ to $R^{25}$ may be the same or different and each represents a hydrogen atom, a halogen atom, a hydroxy group, an amino group, a nitro group, a cyano group, a carboxy group or its salt, a sulfo group or its salt, an alkyl group, an alkenyl group, an aryl group, or an $R^{26}$-D-group wherein $R^{26}$ represents an alkyl group or an aryl group and D represents $—SO_2—$, —O—, —S—, —CO—, —COO—, —OCO—, —CONH—, —NHCO—, $—SO_2NH—$, or $—NHSO_2—$.

The imidazole compound contained in the silver halide photographic light-sensitive material of the invention may also be represented by Formula III below:

$$(A)_X(B)_Y \qquad \text{Formula III}$$

where A represents a repeating unit derived from an ethylenically unsaturated monomer having at least one imidazole group, B represents a repeating unit derived from a monomer other than A, and each of X and Y represents a percentage by weight of each repeating unit, X representing 0.1 to 100, and Y representing 0 to 99.9.

Preferably, the substantially perfect cubic grains have a silver chloride content of 3 mol % or less and a silver iodide content of 0.5 mol % or more, and are chemically sensitized and also spectrally sensitized with a sensitizing dye.

Also preferably, the silver halide emulsion contains an iridium compound.

DETAILED DESCRIPTION OF THE PREFERRED EMBODIMENTS

The present invention will be described in detail below.

A silver halide photographic light-sensitive material of the present invention is characterized by containing an imidazole compound in the light-sensitive material and having a silver halide emulsion containing substantially perfect cubic silver halide grains.

The "substantially perfect cube or cubic grains" refers to a cube whose corners or edges are almost not chipped. This means that (100) faces constituting a cube are unlimitedly close to squares or rectangles. This substantially perfect cube is defined as follows.

Figure 1:
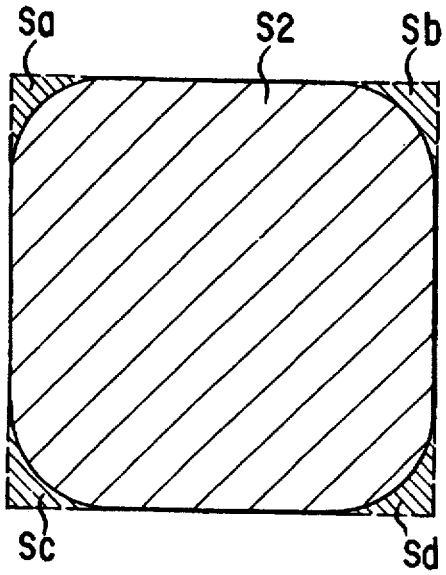
FIG. 1 is a view for explaining areas S1 and S2 used to calculate the perfection ratio of a cubic emulsion.

Shadowing is performed for a (100) face of a cubic emulsion at an angle of 45° by using carbon, forming a sample by a regular replica process. The sample is photographed in a direction perpendicular to the (100) face by using an electron microscope. Subsequently, the edges of the (100) face facing upward are extended to form a quadrangle that is geometrically surrounded by four straight lines, and the area of the quadrangle is calculated as S1. Thereafter, the surrounding of the (100) face, that is not shadowed and exits on perfectly the same plane as the (100) face, is drawn, and its area is calculated as S2 (if intraface epitaxy is present, the area of the (100) face is calculated assuming that the epitaxy is not present). If S1=S2, the cube is a geometrically perfect cube. The cube of the present invention has S2/S1 of 0.96 or more and is in this way defined as a substantially perfect cube. This S2/S1 will be referred to as a perfection ratio hereinafter. The perfection ratio is preferably as large as possible, and a cube having that of 0.99 or more is more preferable. FIG. 1 schematically shows the method of obtaining S1 and S2.

A silver halide emulsion constituting a highsensitivity color photographic light-sensitive material of the present invention preferably contains 0.5 mol % or more of silver iodide in order to increase the sensitivity and enhance adsorption of sensitizing dyes to impart stability with time to the material. In the silver halide emulsion according to the present invention, the silver iodide content can be any given value. However, to provide an emulsion with a hard contrast and a high color density, the range of the silver iodide content is preferably 0.5 to 20 mol %, and more preferably 0.5 to 5 mol %. In the case of a silver halide containing silver iodide, formation of the substantially perfect cubes described above becomes more difficult than in the cases of silver chloride, silver chlorobromide, and pure silver bromide. The present invention makes it possible to form substantially perfect cubes of a silver halide containing silver iodide, which has been considered difficult to form, and thereby takes advantage of not only the characteristics of the substantially perfect cube, i.e., a high sensitivity and a hard contrast but the characteristics of silver iodide, i.e., the functions of enhancing adsorption of sensitizing dyes and controlling chemical sensitization.

In a silver halide of the present invention, a silver chloride content can be any arbitrary value, but it is preferably 3 mol % or less, and pure silver bromoiodide not containing silver chloride at all can also be used. If the silver chloride content exceeds 3 mol %, formation of the substantially perfect cubes defined in the present invention becomes relatively easier in the step of grain formation, but deformation of grains undesirably easily occurs in the step of chemical sensitization for achieving a high sensitivity or while the grains are in a solution before coating. In addition, adsorption of sensitizing dyes is weakened, and this makes it difficult to maintain the performance of coated films with time in a high-humidity condition. JP-A-55-124139 discloses that a perfect cube can be formed by selectively growing silver chloride in a silver amount of 10% at the corners of a silver bromoiodide cube whose corners are slightly chipped. However, such an inhomogeneous grain is extremely poor in stability and therefore cannot keep its shape after the chemical sensitization step for obtaining a high sensitivity. Also, a grain of this type has no superiority in photographic properties. In the present invention, therefore, it is most preferable that substantially no silver chloride be contained.

"Substantially no silver chloride" means that the addition amount of chloride ions in formulation in the process of manufacturing a silver halide emulsion is 1 mol % or less with respect to the addition amount of silver nitrate or that the silver chloride content of a silver halide grain is 0.1 mol % or less.

Imperfect cubes inapplicable to the present invention are cubes with perfection ratios of less than 0.96. These cubes are roughly classified into two types: one is a cube in which (111) faces remain at the corners of the cube because the growth rate of the (100) faces is not high enough compared to that of (111) faces due to, e.g., a high pAg; the other is a cube whose corners are rounded under the influence of physical ripening during the emulsion manufacturing process. In either case, the cube is low in sensitivity and soft in gradation compared to the substantially perfect cube of the present invention, and its maximum color density also decreases. Conversely speaking, the potential of a cube cannot be brought out unless the perfect cube of the present invention is used, and this makes it possible to provide a silver halide emulsion having a very high performance, i.e., having a high sensitivity, a hard gradation, and a high color density compared to those of conventional cubes. The reasons why such a perfect cube cannot be formed by conventional techniques are, for example, that it is originally difficult to form a cube with a silver halide containing silver iodide, and that even if a cube is formed in the step of grain formation, the cube is readily influenced by physical ripening in the subsequent desalting step or chemical sensitization step, as will be described later, and this rounds the corners of the cube to cause the cube to lose its perfection.

Although the substantially perfect cubic emulsion of the present invention can be manufactured by any suitable method, representative manufacturing methods will be described below.

A silver halide grain serving as a nucleus of the silver halide emulsion of the present invention can be formed by any conventional method as long as the grain is a regular crystal. A preferable method is to add an aqueous silver nitrate solution and an aqueous water-soluble halide salt solution to an aqueous gelatin solution by double-jet. A controlled double-jet method in which a pAg is controlled is more preferable. The history of a pAg may be such that it is high in the initial stages of nucleation and gradually decreased with addition or vice versa. The pAg can also be maintained constant from the start to the end of nucleation.

As the shape of a silver halide emulsion serving as a nucleus, a tetradecahedron is more preferable than an octahedron, and a cube is more preferable than a tetradecahedron. A cube is most preferably the one that meets the definition of the substantially perfect cube of the present invention.

As the silver halide grains as nuclei, it is preferable to use a silver halide emulsion prepared in a large amount beforehand as seed crystals.

It is known that the crystal habit of a regular crystal depends on the pAg during growth; generally, in a system not using a silver halide solvent such as ammonia, cubes, tetradecahedrons, and octahedrons are formed at a pAg of 7 or less, 7 to 8, and 8 or more, respectively. Manufacturing a silver halide without using any silver halide solvent such as ammonia prevents production of unnecessary silver nuclei during grain formation and is therefore preferable to provide a silver halide photographic light-sensitive material having a low fog and a high storage stability.

The mechanism by which the crystal habit changes depending on a pAg has not been completely uncovered yet. However, as described in James et al., "The Theory of Photographic Process," it is generally agreed that the condition of adsorption of bromide ions to faces changes depending on the bromide ion concentration, and this produces a difference in growth rate between (111) and (100) faces to cause the crystal habit to change.

Figure 2:
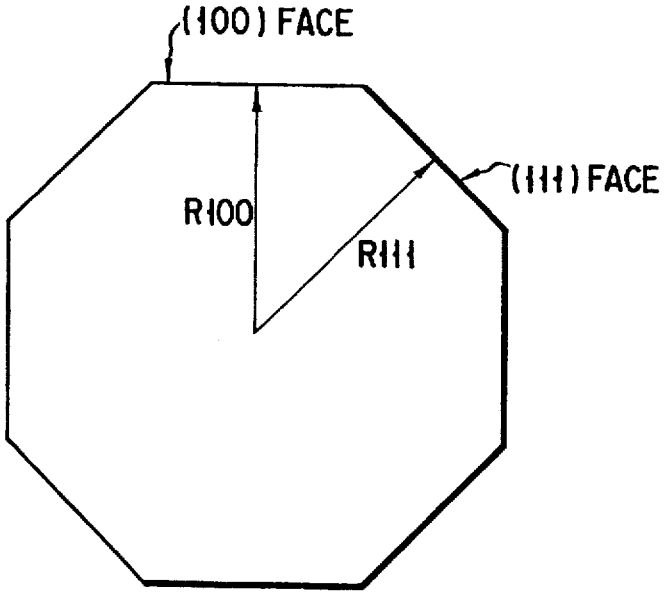
FIG. 2 is a view showing the distance from the center to a (100) face or a (111) face of a tetradecahedral grain.

Assume that, as shown in FIG. 2, a distance from the center to a (100) face of a tetradecahedral grain is R100, and a distance from the center to a (111) face of the grain is R111.

As can be readily understood from FIG. 2, R111, R100, and a ratio (dR111/dt)/(dR100/dt) of the growth rates of the two faces before growth is started determine the crystal habit of the final grain. In order for the grain to become a perfect cube, it is necessary that the (111) faces grow faster than the (100) faces and the (100) faces finally disappear. Geometrically, $(dR111/dt)/(dR100/dt)>3^{1/2}$ (=1.73). In J. Colloid. Interface Sci. 93, 461 (1983), Sugimoto obtained the pBr (pAg) dependencies of the critical growth rates of the (100) face and the (111) face. According to this literature, a relation of $(dR111/dt)/(dR100/dt)>3^{1/2}$ (=1.73) is satisfied for pAg<6.5. That is, to manufacture the substantially perfect cubes of the present invention, growth must be performed at a pAg of 6.5 or less when a silver halide solvent such as ammonia is not used.

When a silver halide emulsion is to be manufactured in a low-pAg environment at a pAg of 8 or less, a controlled double-jet method is normally used, which performs addition of silver nitrate and an aqueous halide salt solution at the same time while controlling the pAg. As a method to control a pAg to a target value by controlling the addition amount of an aqueous halide salt solution or silver nitrate, a PID control method disclosed in, e.g., JP-A-61-65302 is common. When control is performed at a pAg close to an equivalence point of 6.5 or less in order to manufacture the substantially perfect cubes of the present invention, an excess halogen concentration present in a reaction solution decreases to cause the pAg to largely vary even with a slight change in flow rate, making it difficult to control the pAg to a target value. In that case, control can be stably performed by, e.g., improving the condition of stirring, decreasing the addition rate of silver nitrate, decreasing the concentration of an aqueous halogen solution, and/or optimizing the PID parameters. Alternatively, control can be performed on the silver excess side by selecting a pAg lower than the equivalence point.

It is generally known that cubes can be formed at a relatively high pAg when a silver halide solvent such as ammonia is used. The present inventor has confirmed that a pAg capable of meeting the condition of $(dR111/dt)/(dR100/dt)>3^{1/2}$ (=1.73) can be raised up to 7.5 in the presence of 0.2 mol/l of ammonia. However, when a silver halide is grown in the presence of a silver halide solvent, physical ripening (to be described later) becomes liable to occur, and so a means for preventing physical ripening must be selected with enough care.

An example of a compound preferably used in forming cubes at a relatively high pAg is a nitrogen-containing heterocyclic compound such as mercaptotriazoles and mercaptotetrazoles.

Several compounds, other than a silver halide solvent, that can increase the pAg during formation of cubes are also known. A sensitizing dye that is adsorbed preferentially to (100) faces makes it feasible to form cubes at a high pAg. In addition, F. H. Claus et al. describe in Phot. Sci. Eng., 12(4), page 207 (1968) that association of a solvent (water) has a large influence on a crystal habit, demonstrating that diluting with water, decreasing an electrolyte concentration, and adding urea, for example, are the methods of forming cubes at a high pAg.

A polymer, described below, having a repeating unit containing at least one basic nitrogen atom is also useful in forming cubes at a high pAg.

Formation of cubes at a high pAg without using a silver halide solvent, such as the method using, e.g., the polymer having a repeating unit containing a basic nitrogen atom, urea, or sensitizing dyes as described above is preferable in preventing an increase in the process of physical ripening to be described later. In addition, control of a high pAg is relatively easy even in a large scale and is therefore a very favorable method in terms of suitability for manufacture.

It is preferable to use an oxidizer for silver during the manufacture of emulsions of the present invention. The use of the oxidizer is more preferable especially when a silver halide solvent such as ammonia is used.

The oxidizer for silver means a compound having an effect of converting metal silver into silver ions. A particularly effective compound is the one that converts very fine silver grains, formed as a by-product in the process of formation of silver halide grains and chemical sensitization, into silver ions. The silver ions produced may form a silver salt hardly soluble in water, such as a silver halide, silver sulfide, or silver selenide, or a silver salt readily soluble in water, such as silver nitrate. The oxidizer for silver may be either an inorganic or organic substance. Examples of the inorganic oxidizer are ozone, hydrogen peroxide and its adducts (e.g., $NaBO_2 \cdot H_2O_2 \cdot 3H_2O$, $2NaCO_3 \cdot 3H_2O_2$, $Na_4P_2O_7 \cdot 2H_2O_2$, and $2Na_2SO_4 \cdot H_2O_2 \cdot 2H_2O$), peroxy acid salts (e.g., $K_2S_2O_8$, $K_2C_2O_6$, and $K_2P_2O_8$), peroxy complex compounds (e.g., $K_2[Ti(O_2)C_2O_4] \cdot 3H_2O$, $4K_2SO_4 \cdot Ti(O_2)OH \cdot SO_4 \cdot 2H_2O$, and $Na_3[VO(O_2)(C_2H_4)_2] \cdot 6H_2O$), permanganates (e.g., $KMnO_4$), oxyacid salts such as chromates (e.g., $K_2Cr_2O_7$), halogen elements such as iodine and bromine, perhalogenates (e.g., potassium periodate), salts of a high-valence metal (e.g., potassium hexacyanoferrate(II)), and thiosulfonate.

Examples of the organic oxidizer are quinones such as p-quinone, organic peroxides such as peracetic acid and perbenzoic acid, and compounds which release active halogen (e.g., N-bromosuccinimide, chloramine T, and chloramine B).

Preferable oxidizers used in the present invention are ozone, hydrogen peroxide and its adduct, a halogen element, an inorganic oxidizer such as a thiosulfonate, and an organic oxidizer such as a quinone. A combination of the reduction sensitization described below and the oxidizer for silver is preferable. In this case, the reduction sensitization may be performed after the oxidizer is used or vice versa, or the reduction sensitization and the use of the oxidizer may be performed at the same time. These methods can be performed during grain formation or chemical sensitization.

An ion located at the corner of a cube can be removed simply by cutting only three bonds adjacent to that corner. Likewise, an ion at the edge is held by four bonds, and that in a (100) face is held by five bonds. This means that the corners of a cube are in a very unstable state; they are readily susceptible to physical ripening and easily chipped or rounded. To form the substantially perfect cubes of the present invention, a care must be taken to eliminate physical ripening in each and every step from grain formation to coating of emulsions on a support.

In the step of performing growth with the pAg kept constant after nucleation, it is preferable to perform the growth at a rate close to the critical growth rate so as to eliminate physical ripening. More specifically, to allow the addition rate of an aqueous silver nitrate solution to be proportional to the surface area of grains in a reaction solution, the addition rate of silver nitrate can be gradually increased as a linear or quadratic function of time. The critical growth rate can be obtained by performing growth while changing the addition rate immediately after the start of growth and by checking whether nucleation occurs again during the growth. The addition rate is preferably 70% or more, and more preferably 85% or more of the critical growth rate.

The temperature during growth of a silver halide is normally within the range of 35° C. to 90° C., and lower temperatures within this range are preferable in eliminating physical ripening. Note that since the critical growth rate also decreases when the temperature decreases, a time required to finish the growth of silver halide grains is prolonged relative to the rate, and this sometimes increases the probability that the grains are influenced by physical ripening. An optimal temperature for manufacturing the perfect cubes of the present invention exists, but the temperature depends on various factors, such as the type and concentration of gelatin, the grain size, the type and amount of a solvent, and the presence/absence of additives. Therefore, the optimal temperature must be so selected in accordance with these conditions.

Addition of a silver halide adsorbent is also preferable to eliminate the influence of physical ripening. For this purpose, any adsorbent that is adsorptive to a silver halide can be used provided that the adsorbent is strongly adsorptive and has no adverse effect on photographic properties. To form the substantially perfect cubes of the present invention, a compound having a mercapto group and/or a sensitizing dye is preferably used. These adsorbents can be added at any point during the process of manufacturing a silver halide emulsion as long as physical ripening can be prevented. Sensitizing dyes, however, are most preferably added to a silver halide emulsion before chemical sensitization is started. These compounds not only prevent physical ripening, but have functions as an antifoggant and a sensitizer, in the case of a compound having a mercapto group, and as a spectral sensitizer, in the case of a sensitizing dye. Therefore, if physical ripening is prevented by some other means, these compounds can be added to an emulsion after chemical sensitization and immediately before coating.

Some of these adsorbents have properties of specifically increasing the growth rate of (111) faces or decreasing the growth rate of (100) faces. Adding such an adsorbent before completion of grain formation is very preferable because it not only prevents physical ripening but effectively increases the pAg required to form the substantially perfect cubes of the present invention.

Among the compounds having a mercapto group, a nitrogen-containing heterocyclic compound having a mercapto group is most preferable, such as mercaptotriazoles and mercaptotetrazoles.

In the present invention, as described above, sensitizing dyes are usable as physical ripening inhibitors or crystal habit regulators capable of forming cubes at a high pAg in the step of grain formation. Sensitizing dyes, however, are originally used for the purpose of extending the wavelength of radiation, to which a silver halide emulsion can be sensitive, from the intrinsic region to a long-wavelength region. The present inventor has made researches and found that the effect of improving photographic properties was small even by increasing the perfection ratio of a cube when no spectral sensitization by sensitizing dyes was performed, and that a very large effect of the use of the substantially perfect cubes could not be obtained unless spectral sensitization was performed by using sensitizing dyes. In the present invention, therefore, spectral sensitization using sensitizing dyes is essential.

Therefore, photographic emulsions used in the present invention are subjected to spectral sensitization by a sensitizing dye such as a methine dyes in order to achieve the effects of the present invention. Usable dyes include a cyanine dye, a merocyanine dye, a composite cyanine dye, a composite merocyanine dye, a holopolar cyanine dye, a hemicyanine dye, a styryl dye, and a hemioxonole dye. Most useful dyes are those belonging to a cyanine dye, a merocyanine dye, and a composite merocyanine dye. These dyes may have any nucleus commonly used as a basic heterocyclic nucleus in cyanine dyes. Examples of such a nucleus are a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus, and a pyridine nucleus; a nucleus in which an aliphatic hydrocarbon ring is fused to any of the above nuclei; and a nucleus in which an aromatic hydrocarbon ring is fused to any of the above nuclei, e.g., an indolenine nucleus, a benzindolenine nucleus, an indole nucleus, a benzoxadole nucleus, a naphthoxazole nucleus, a benzthiazole nucleus, a naphthothiazole nucleus, a benzoselenazole nucleus, a benzimidazole nucleus, and a quinoline nucleus. These nuclei may be substituted on a carbon atom.

A merocyanine dye or a composite merocyanine dye may have a 5- or 6-membered heterocyclic nucleus as a nucleus having a ketomethylene structure. Examples are a pyrazolin-5-one nucleus, a thiohydantoin nucleus, a 2-thiooxazolidin-2,4-dione nucleus, a thiazolidin-2,4-dione nucleus, a rhodanine nucleus, and a thiobarbituric acid nucleus.

Although these sensitizing dyes may be used singly, they can also be used together. The combination of sensitizing dyes is often used for a supersensitization purpose. Representative examples of the combination are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patents 1,344,281 and 1,507,803, JP-B-43-4936, JP-B-53-12375, JP-A-52-110618, and JP-A-52-109925.

Emulsions used in the present invention may contain, in addition to the sensitizing dyes, dyes having no spectral sensitizing effect or substances not essentially absorbing visible light and presenting supersensitization.

The sensitizing dyes can be added to an emulsion at any point in preparation of an emulsion, which is conventionally known to be useful. Most ordinarily, the addition is performed after completion of chemical sensitization and before coating. However, it is possible to perform the addition at the same timing as addition of chemical sensitizing dyes to perform spectral sensitization and chemical sensitization simultaneously, as described in U.S. Pat. Nos. 3,628,969 and 4,225,666. It is also possible to perform the addition prior to chemical sensitization, as described in JP-A-58-113928, or before completion of formation of a silver halide grain precipitation to start spectral sensitization. Alternatively, as disclosed in U.S. Pat. No. 4,225,666, these compounds can be added separately; a portion of the compounds may be added prior to chemical sensitization, and the remaining portion is added after that. That is, the compounds can be added at any timing during formation of silver halide grains, including the method disclosed in U.S. Pat. No. 4,183,756.

The addition amount of the sensitizing dye may be $4\times10^{-6}$ to $8\times10^{-3}$ mole per mole of silver halide. However, for a more preferable silver halide grain size of 0.2 to 1.2 μm, an addition amount of about $5\times10^{-5}$ to $2\times10^{-3}$ mole per mole of silver halide is more effective.

Physical ripening also occurs in the step of desalting. For the desalting purpose, the emulsion of the present invention is preferably washed with water and dispersed in a protective colloid that is newly prepared. The temperature of water for washing is preferably selected from 5° C. to 50° C. To prevent physical ripening in the desalting step, the desalting is performed in the presence of the adsorbents described above or with the pAg controlled. The desalting is performed at a pAg of 5 to 10 for normal emulsions. The solubility of a silver halide can be calculated from the temperature, the pKsp, and the dissociation constant and the formation enthalpy of AgBr, $AgBr_2$, $AgBr_3$ and $AgBr_4$, described in James et al., "The Theory of Photographic Process." Within the range of temperatures of 30° C. to 50° C. in the regular desalting step, the solubility of a silver halide is lowest near pAg=8. To prevent exposure of (111) faces, the pAg is preferably as low as possible. For these reasons, in order to prevent physical ripening by controlling the pAg during desalting of an emulsion of the present invention, the pAg is preferably set between 7 and 8.

Also, the pH during washing is preferably selected between 2 and 10. The washing method can be selected from a noodle washing process, a dialysis process using a semipermeable membrane, a centrifugal separation process, a coagulation sedimentation process, and an ion exchange process. The coagulation sedimentation process can be performed by using a sulfate, a water-soluble polymer, or a gelatin derivative.

Grains are also subject to physical ripening in chemical sensitization. The chemical sensitization is commonly performed at a temperature of 40° C. to 90° C. Grains are susceptible to physical ripening especially when a chemical sensitizer functioning also as a silver halide solvent, such as a thiocyanate salt, is used. Although the chemical sensitization can be performed at a pAg of 7 to 8 as in the desalting, it is preferable to perform the chemical sensitization at a pAg of 5 to 11 in the presence of the adsorbents described above. It is known that the presence of an adsorbent in the chemical sensitization is preferable in limiting the site at which the chemical sensitization is performed as well as preventing physical ripening or obtaining the sensitizing effects of the individual compounds.

The silver halide emulsion used in the present invention preferably has a distribution or a structure with respect to a halogen composition in its grains. A typical example of such a grain is a core-shell or double structure grain having different halogen compositions in its interior and surface layer as disclosed in, e.g., JP-B-43-13162, JP-A-61-215540, JP-A-60-222845, JP-A-60-143331, or JP-A-61-75337. The structure need not be a simple double structure but may be a triple structure or a multiple structure larger than the triple structure as disclosed in JP-A-60-222844. It is also possible to bond a thin silver halide having a different composition from that of a core-shell double-structure grain on the surface of the grain.

In the case of, e.g., a silver bromoiodide grain having any of the above structures, the silver iodide content at the core may be higher than that of the shell. In contrast to this, the silver iodide content at the core may be low while that at the shell is high.

When the equivalent-sphere diameter of a grain is 0.5 μm or less, dislocation lines of the grain can be observed by a transmission electron microscope. The silver halide grain of the present invention either may or may not have dislocation lines. When the substantially perfect cube of the present invention has dislocation lines, the cube becomes difficult to manufacture because it becomes more susceptible to physical ripening. However, the cube may contain dislocation lines in accordance with the intended use.

Dislocations can be introduced linearly with respect to a specific direction of a crystal orientation of a grain or curved with respect to that direction. It is also possible to selectively introduce dislocations throughout an entire grain or only to a particular portion of a grain, e.g., the fringe portion of a grain. When dislocations are limitedly introduced to the fringe portion, dislocation lines of each grain can be counted by observing the grain by using an electron microscope. In the silver halide grains of the present invention, it is preferable that 30 or less, and more preferably 10 or less dislocation lines be observed per grain.

The grain size of a silver halide emulsion used in the present invention can be evaluated in terms of the equivalent-sphere diameter of the volume of a grain, calculated from the length of a side of a cubic emulsion by using an electron microscope, or the equivalent-sphere diameter of the volume, obtained by a Coulter counter method. It is possible to use various grains from a very fine grain having an equivalent-sphere diameter of 0.05 μm or less to a large grain having that of 10 μm or more. In the case of a silver halide of the present invention, the equivalent-sphere diameter is preferably 0.05 to 2.0 μm, and more preferably 0.05 to 1.0 μm.

A silver halide emulsion for use in the present invention is preferably a monodisperse silver halide emulsion. "Monodisperse" means that the variation coefficient of equivalent-sphere diameters of an emulsion is 0.20 or less when observed by an electron microscope. That is, an emulsion in which the value (variation coefficient) of a quotient obtained by dividing a standard deviation s of a distribution of equivalent-sphere diameters by an average equivalent-sphere diameter r is 0.20 or less is the monodisperse emulsion.

In order for a light-sensitive material to satisfy its target gradation, two or more monodisperse silver halide emulsions having different grain sizes and containing at least one of silver halide emulsions of the present invention can be mixed in a single emulsion layer having essentially the same color sensitivity or can be coated as different layers. It is also possible to mix two or more types of polydisperse silver halide emulsions or monodisperse emulsions together with poly-disperse emulsions in a single layer, or to coat them as different layers.

The substantially perfect cubic silver halide grains of the present invention can be added in any light-sensitive emulsion layer of a multilayered color light-sensitive material. However, the cubic grains are preferably used in a medium-speed layer and/or a low-speed layer, so that they may more prominently exhibit their advantages that they can save the silver amount used without impairing the image quality and exhibit high sensitivity at high illumination intensity exposure. Further, the cubic grains of the invention can be used in any desired amount in multiple layers, but it is preferably used in an amount of 5% to 100% by weight, more preferably 10% to 80% by weight, of all the silver halide grains used. Furthermore, when the substantially perfect cubic grains of the invention are used, the silver amount can be reduced to 50% to 70% of the silver amount required when silver halide grains other than those of the invention are used to obtain the same photographic properties and the same image quality.

The silver halide photographic light-sensitive material of the present invention is characterized by containing an imidazole compound. Although the photographic effects of an imidazole compound have not been known well yet, its properties as a silver halide solvent are generally known as disclosed in, e.g., JP-B-62-2301 and JP-A-58-54333.

The present inventor has found that an imidazole compound presents an unexpected effect of increasing sensitivity upon high illumination intensity exposure when combined with the substantially perfect silver halide cubes of the invention. The present inventor has not elucidated the mechanism of this effect yet, but considers that an imidazole compound has adsorptivity, albeit weak, to a silver halide and, when used together with substantially perfect cubes, adsorbs to imperfect faces more or less remaining to further improve the perfection of the cubes, thereby preventing latent image dispersion which is a cause of a high illumination intensity reciprocity failure.

As disclosed in JP-A-58-54333 and JP-B-62-2301, an imidazole compound is known to have a function as a silver halide solvent and used during grain growth. However, no use of an imidazole compound in a substantially perfect cubic emulsion of the present invention has been conventionally reported. Therefore, sensitivity upon high-intensity exposure when the essentially perfect cubic emulsion is combined with an imidazole compound has been totally unpredicted.

In addition, the combination of an imidazole compound and an iridium compound used during grain growth is disclosed in JP-A-61-205930. The effects of this combination, however, are primarily an effect of suppressing pressure marks and a sensitizing effect at an exposure time of 1/100 second or more, and the sensitizing effect of the iridium compound is known to those skilled in the art. For this reason, the degree of the synergistic effect of an iridium compound and an imidazole compound is still unknown, and JP-A-61-205930 has no description concerning the effect for the high-intensity sensitivity, which the present invention is intended to achieve. Furthermore, it is presumed that the silver halide grains exemplified in the Examples of JP-A-61-205930 are imperfect cubic grains, although their shapes are not described and hence are unknown.

Any monomeric or polymeric imidazole compound can be used in the present invention, provided that it contains an imidazole group. Preferable imidazole compounds are those represented by the formulas presented below, but the present invention is not limited to these compounds.

In the present invention, an imidazole compound represented by Formula I below can be used:

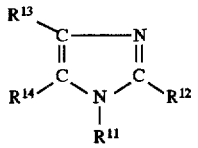

Formula I where $R^{11}$, $R^{12}$, $R^{13}$, and $R^{14}$ may be the same or different and each represents a hydrogen atom, or an alkyl group, an alkenyl group, an aryl group or an aralkyl group, each of which group is either unsubstituted or substituted with at least one member selected from the group consisting of hydroxyl, cyano, alkoxy, and free or esterified carboxyl or sulfo.

Preferably, the alkyl group has 1 to 8, more preferably 1 to 4 carbon atoms, such as methyl or ethyl.

Preferably, the alkenyl group has 2 to 8 carbon atoms, such as allyl, butenyl, or hexenyl. Most preferably, the alkenyl group has 2 to 4 carbon atoms, such as vinyl or allyl.

Preferably, the aryl group has 6 to 12 carbon atoms, such as phenyl, biphenyl, or naphthyl. A most preferable aryl group is phenyl.

Preferably, the aralkyl group has 1 to 2 carbon atoms in the aliphatic portion and 6 to 12 carbon atoms in the aromatic portion, such as benzyl or phenylethyl.

When the alkyl, alkenyl, aryl, or aralkyl group is substituted, a preferable example of the substituent is at least one selected from the group consisting of hydroxy, cyano, alkoxy, and free or esterified carboxy or sulfo.

Practical examples of a compound represented by Formula I are as follows.

| | |
|---|---|
| IM-1 | Imidazole |
| IM-2 | 1-methylimidazole |
| IM-3 | 2-methylimidazole |
| IM-4 | 1,2-dimethylimidazole |
| IM-5 | 1-allylimidazole |
| IM-6 | 1-vinylimidazole |
| IM-7 | 1-methoxymethylimidazole |
| IM-8 | 1-(2-carboxyethyl)-imidazole |
| IM-9 | 4-methylimidazole |
| IM-10 | 2-ethyl-4-methylimidazole |

In the present invention, a benzimidazole compound represented by Formula II below can be also used:

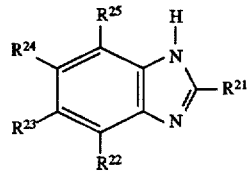

Formula II where $R^{21}$ represents a hydrogen atom, a halogen atom (e.g., Cl, Br or I), an alkyl group, an alkenyl group, an aryl group, or a heterocyclic group; and $R^{22}$ to $R^{25}$ may be the same or different and each represents a hydrogen atom, a halogen atom (e.g., Cl, Br or I), a hydroxy group, an amino group, a nitro group, a cyano group, a carboxy group or its salt (particularly an alkali metal salt), a sulfo group or its salt (particularly an alkali metal salt), an alkyl group, an alkenyl group, an aryl group, or an $R^{26}$-D- group wherein $R^{26}$ represents an alkyl group or an aryl group and D represents —$SO_2$—, —O—, —S—, —CO—, —COO—, —OCO—, —CONH—, —NHCO—, —$SO_2$NH—, or —NH$SO_2$—.

The alkyl group represented by $R^{21}$ includes a substituted alkyl group. Preferably, the alkyl group has 1 to 8, more preferably 1 to 4 carbon atoms. Examples of the substituent are a hydroxy group, a cyano group, an alkoxy group, a unsubstituted, mono-substituted or di-substituted amino group, a morpholino group, a free or esterified carboxyl group, a free or esterified sulfo group, and an aryl group. Practical examples of the alkyl group are methyl, ethyl, propyl, hydroxymethyl, hydroxypropyl, diethylaminomethyl, morpholinomethyl, benzyl, phenethyl, and carboxymethyl.

The alkenyl group represented by $R^{21}$ also includes a substituted alkenyl group. Preferably, the alkenyl group has 3 to 8, more preferably 3 or 4 carbon atoms. Examples of the substituent are those enumerated above as the substituents for the alkyl group represented by $R^{21}$. Practical examples of the alkenyl group are allyl, butenyl, and octenyl.

The aryl group represented by $R^{21}$ includes a substituted aryl group. Preferably, the aryl group has 6 to 12 carbon atoms. Examples of the substituent are those enumerated above as the substituents for the alkyl group represented by $R^{21}$, and alkyl groups having 1 to 4 carbon atoms. Practical examples of the aryl group are phenyl and tolyl.

Preferably, the heterocyclic group represented by $R^{21}$ is 5- or 6-membered, and contains a nitrogen atom or an oxygen atom as the a member of the heterocyclic ring, such as a pyridyl group, a pyrimidyl group, or a furyl group. 2-pyridyl is most preferred.

The alkyl, alkenyl and aryl groups represented by $R^{22}$ to $R^{25}$ are selected from the same range as for the alkyl, alkenyl, and aryl groups described above for $R^{21}$.

The alkyl group represented by $R^{26}$ of the $R^{26}$-D-group is preferably a lower alkyl group having 1 to 4 carbon atoms, and the aryl group represented by $R^{26}$ preferably has 6 to 12 carbon atoms, particularly a phenyl group. Practical examples of the $R^{26}$-D- group are methylsulfonyl, phenylsulfonyl, acetoxy, methoxycarbonyl, acetylamino, benzoylamino, carbamoyl, methylsulfonylamino, and sulfamoyl.

Of the compounds represented by Formula II, those in which $R^{21}$ represents a hydrogen atom or a lower alkyl group and each of $R^{22}$ to $R^{25}$ represents a hydrogen atom are preferred.

Practical examples of a compound represented by Formula II are as follows.

BI-1

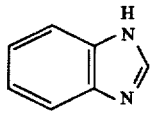

BI-2

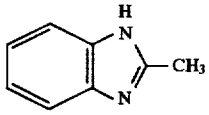

BI-3

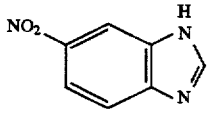

BI-4

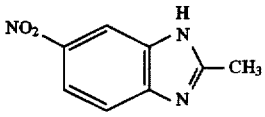

BI-5

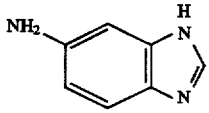

BI-6

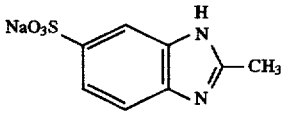

BI-7

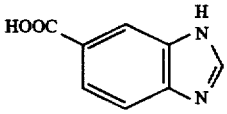

BI-8

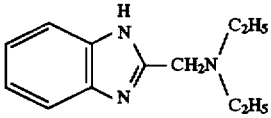

BI-9

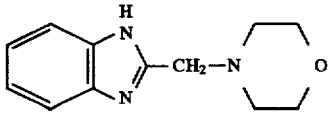

BI-10

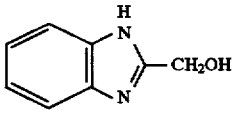

BI-11

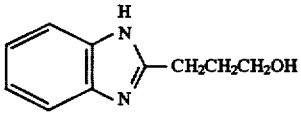

BI-12

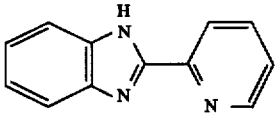

BI-13

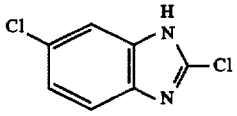

-continued

BI-14

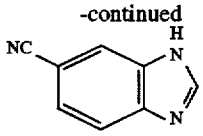

BI-15

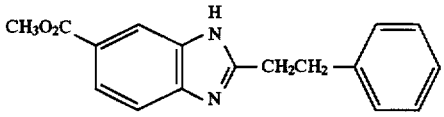

BI-16

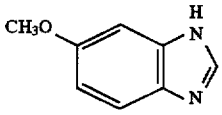

In addition, a synthetic polymer containing an imidazole group, which is represented by Formula III below, can also be used in the present invention:

Formula III where A represents a repeating unit derived from an ethylenically unsaturated monomer having at least one imidazole group, B represents a repeating unit derived from a monomer other than A, and each of X and Y represents a percentage by weight of each monomeric component. X represents 0.1 to 100, and Y represents 0 to 99.9.

Examples of a monomer forming the repeating unit represented by A are monomers having an imidazole substituent, such as vinylimidazole, 2-methyl-lvinylimidazole, N-acryloylimidazole, N-2-acryloyloxyethylimidazole, and N-vinylbenzylimidazole. However, the present invention is not limited to these examples.

These monomers can be used either singly, or in combination in a polymer of Formula III.

Preferably, the repeating unit B is derived from a copolymerizable ethylenically unsaturated monomer whose homopolymer is soluble in any of neutral water, an acidic aqueous solution, and an alkaline aqueous solution. Practical examples of the monomer are a nonionic monomer, such as acrylamide, methacrylamide, N-methylacrylamide, N,N-dimethylacrylamide, N-acryloylmorpholine, N-ethylacrylamide, diacetoneacrylamide, N-vinylpyrrolidone or N-vinylacetamide; a monomer having an anionic group, such as acrylic acid, methacrylic acid, itaconic acid, vinylbenzoic acid, styrenesulfonic acid, styrenesulfinic acid, phosphonoxyethylacrylate, phosphonoxyethylmethacrylate, 2-acrylamido-2-methylpropanesulfonic acid, 3-acrylamidopropionic acid or 11-acrylamidoundecanoic acid, or its salt (e.g., sodium salt, potassium salt, or ammonium salt); and a monomer having a cationic group, such as N,N,N-trimethyl-N-vinylbenzylammonium chloride or N,N,N-trimethyl-N-3-acrylamidopropylammonium chloride.

The repeating unit B can contain a copolymer component that is rendered water-soluble by, e.g., hydrolysis. Examples are a repeating unit derived from vinyl alcohol (obtained by hydrolysis of a vinyl acetate unit), and a repeating unit derived from maleic acid (obtained by ring opening of maleic anhydride).

Of these repeating units B, the repeating unit derived from a nonionic monomer or an anionic monomer is most preferable.

These ethylenically unsaturated monomers forming the repeating unit B can be used either singly or in combination in the polymer as desired.

The imidazole polymer of the present invention can also be copolymerized with another hydrophobic ethylenically unsaturated monomer as long as the water solubility of the polymer is impaired. Examples of such a monomer are ethylene, propylene, 1-butene, isobutene, styrene, α-methylstyrene, methylvinylketone, a monoethylenically unsaturated ester of an aliphatic acid (e.g., vinyl acetate and allyl acetate), an ester of an ethylenically unsaturated monocarboxylic acid or dicarboxylic acid (e.g., methyl methacrylate, ethyl methacrylate, n-butyl methacrylate, n-hexyl methacrylate, 2-ethylhexyl methacrylate, cyclohexyl methacrylate, benzyl methacrylate, methyl acrylate, ethyl acrylate, n-butyl acrylate, 2-hydroxyethyl methacrylate, 2-methoxyethyl methacrylate, 2-methanesulfonamidoethyl methacrylate, and monomethyl maleate), an amide of an ethylenic unsaturated monocarboxylic acid (e.g., t-butylacrylamide, t-octylacrylamide, and 3-methoxypropylmethacrylamide), a monoethylenically unsaturated compound (e.g., acrylonitrile and methacrylonitrile), and a diene (e.g., butadiene and isoprene).

Each of X and Y represents the percentage by weight of each copolymer component. X and Y vary depending on, e.g., the structure of a monomer used and the intended use, but X is 0.1 to 100, preferably 1 to 50, and most preferably 1 to 30, and Y is 0 to 99.9, preferably 50 to 99, and most preferably 70 to 99. X+Y are 100.

The imidazole polymer of the present invention can be manufactured by various polymerization methods, such as solution polymerization, precipitation polymerization, suspension polymerization, bulk polymerization, and emulsion polymerization. In addition, a method of initiating the polymerization can be any of, e.g., a method of using a free-radical initiator, a method of radiating light or rays, and a thermal polymerization method. These polymerization methods and initiation methods are described in, e.g., Sadaji Tsuruta, "High Polymer Synthesis Reaction," a revised edition (Nikkan Kogyo Shinbunsha, 1971); and Takayuki Otsu and Masanobu Kinoshita, "Method of High Polymer Synthesis Experiment," Kagaku Dojin, 1972, pages 124 to 154.

Among the above polymerization methods, the solution polymerization method using a free-radical initiator is most preferable. Examples of a solvent for use in the solution polymerization are water and a variety of organic solvents, such as ethyl acetate, methanol, ethanol, 1-propanol, 2-propanol, acetone, dioxane, N,N-dimethylformamide, N,N-dimethylacetamide, toluene, n-hexane, and acetonitrile. These organic solvents can be used either singly or in the form of a mixture of two or more types of them. These organic solvents can also be used in combination with water. Of these solvents, water or a mixture of water and an organic solvent miscible with water is most preferable.

The polymerization temperature depends on the molecular weight of a polymer to be produced or the type of an initiator used. Although a temperature of 0° C. or less to 100° C. or more is possible, the polymerization is usually performed at a temperature of 30° C. to 100° C.

Examples of the free-radical initiator are an azo initiator, such as 2,2'-azobisisobutyronitrile, 2,2'-azobis(2,4-dimethylvaleronitrile), 2,2'-azobis(2-amidinopropane) dihydrochloride, and 4,4'-azobis(4-cyanopentanoic acid), and a peroxide initiator, such as benzoylperoxide, t-butylhydroperoxide, and potassium persulfate (which may also be used as a redox initiator in combination with, e.g., sodium hydrosulfite).

An amount of the initiator can be adjusted depending on the polymerizability of each monomer or the molecular weight of a polymer required. However, it is preferably 0.01 to 10 mole %, and most preferably 0.01 to 2.0 mole % based on the total amount of monomers.

To synthesize the imidazole polymer of the present invention in the form of a copolymer, polymerization may be performed by placing the total amount of monomers to be used in a reactor vessel beforehand and then supplying an initiator. However, it is more preferable to add the monomers dropwise into a polymerization medium. In this case, two or more ethylenically unsaturated monomers to be used may be added dropwise either in the form of a mixture or independently of each other. In the dropwise addition, the ethylenically unsaturated monomers may be dissolved in an appropriate co-solvent. Examples of the co-solvent are water, an organic solvent (such as those described above), and a solvent mixture of water and the organic solvent.

The time required for the dropwise addition varies depending on, e.g., the polymerization reactivity of each ethylenically unsaturated monomer or the polymerization temperature. However, it is preferably 5 minutes to 8 hours, and most preferably 30 minutes to 4 hours. The addition rate can be either equal throughout the addition or varied properly during the addition. When ethylenically unsaturated monomers are added dropwise independently of each other, the total addition time or the addition rate of each monomer can be freely changed as needed. In particular, if the difference in polymerization reactivity between the ethylenically unsaturated monomers is large, it is preferable that, for example, a monomer having a higher reactivity be added more slowly.

The polymerization initiator can be added to a polymerization medium or solvent in advance or can be added simultaneously with the addition of ethylenically unsaturated monomers. The polymerization initiator can also be dissolved in a solvent and added dropwise in the form of a solution independently of ethylenically unsaturated monomers. Two or more types of these addition methods can be combined.

The imidazole polymer of the present invention can be synthesized by the above polymerization reaction using the ethylenically unsaturated monomer having an imidazole group, providing the repeating unit A, and another ethylenically unsaturated monomer, providing the repeating unit B. However, the imidazole polymer can also be synthesized by reacting a compound having an imidazole group with a polymer having a functional group (e.g., —OH, —COOH, —$NH_2$, —NHR, —SH, or an active halogen). Examples of the imidazole compound that can be effectively bonded to a polymer chain are imidazole, 2-hydroxyethylimidazole, N-(3-aminopropyl)imidazole, and 2-hydroxybenzimidazole. These polymer and imidazole compound can be reacted directly or combined through, e.g., a diisocyanate, a diol, a dicarboxylic acid, or a diepoxide.

Practical examples of imidazole polymers represented by Formula III will be presented below, but the present invention is not limited to these examples. The numbers given in parentheses represent the percentage by weight of individual copolymer components.

| | |
|---|---|
| P-1 | Acrylamide/sodium acrylate/vinylimidazole/diacetone acrylamide copolymer (50/5/3/42) |
| P-2 | Acrylamide/sodium acrylate/vinylimidazole/diacetone acrylamide copolymer (42/7/8/43) |
| P-3 | Acrylamide/sodium acrylate/vinylimidazole/diacetone acrylamide copolymer (37/5/15/43) |

-continued

| | |
|---|---|
| P-4 | Acrylamide/acrylic acid/vinylimidazole hydrochloride/diacetone acrylamide copolymer (22/5/30/43) |
| P-5 | Acrylamide/sodium acrylate/vinylimidazole copolymer (90/7/3) |
| P-6 | Acrylamide/sodium acrylate/vinylimidazole copolymer (83/7/10) |
| P-7 | Acrylamide/vinylimidazole copolymer (90/10) |
| P-8 | Methacrylamide/vinylimidazole copolymer (90/10) |
| P-9 | N,N-dimethylacrylamide/vinylimidazole copolymer (92/8) |
| P-10 | Acrylamide/sodium styrenesulfonate/vinylimidazole copolymer (80/10/10) |
| P-11 | Methyl methacrylate/sodium 2-acrylamido-2-methylpropanesulfonate/vinylimidazole copolymer (15/75/10) |
| P-12 | Styrene/acrylamide/sodium 2-acrylamido-2-methylpropanesulfonate/vinylimidazole copolymer (10/40/40/10) |
| P-13 | Acrylamide/sodium methacrylate/2-methyl-1-vinylimidazole/diacetoneacrylamide copolymer (45/5/10/40) |
| P-14 | Acrylamide/2-methyl-1-vinylimidazole copolymer (85/15) |
| P-15 | Acrylamide/sodium acrylate/diacetoneacrylamide/2-methyl-1-vinylimidazole copolymer (38/22/30/10) |
| P-16 | Acrylamide/1-acryloyloxyethylimidazole copolymer (80/20) |
| P-17 | Acrylamide/N-vinylpyrrolidone/1-acryloyloxyethyl-imidazole copolymer (85/5/10) |
| P-18 | Acrylamide/diacetoneacrylamide/N-vinylbenzyl-imidazole copolymer (50/40/10) |
| P-19 | Sodium 2-acrylamido-2-methylpropanesulfonate/3-thiapentyl acrylate/vinylimidazole copolymer (87/3/10) |
| P-20 | Acrylamide/vinylimidazole/N-vinylbenzylpiperidine copolymer (90/5/5) |
| P-21 | Methyl acrylate/acrylamide/sodium acrylate/vinyl-imidazole/1-acryloyloxyethyltriazole copolymer (15/57/15/10/3) |
| P-22 | Acrylamide/sodium acrylate/vinylimidazole/dimethyl-aminomethylstyrene copolymer (75/12/8/5) |

Synthesis examples of the compound of the present invention will be described below.

Synthesis example (synthesis of polymer P-2)

910 g of distilled water were placed in a 2-liter three-necked flask equipped with a stirrer, a reflux condenser, and a thermometer, and stirred at 70° C. under a nitrogen flow. A solution of 0.45 g of potassium persulfate in 65 g of distilled water was added. Immediately thereafter, a solution mixture of 140.6 g of acrylamide, 28.5 g of vinylimidazole, 16.6 g of acrylic acid, 139.5 g of diacetoneacrylamide, 55.9 g of isopropyl alcohol, 250.5 g of distilled water, and 9.46 g of sodium hydroxide was added dropwise at a constant rate over one hour. Then, the mixture was stirred at 70° C. for one hour, and the internal temperature was raised to 90° C. The mixture was further stirred at that temperature for four hours.

The resultant solution was cooled and added with 1 liter of methanol to prepare a polymer solution. The polymer solution was poured into acetone, and precipitation and decantation were repeatedly performed. The resultant precipitate was filtered out and dried to obtain 325.8 g of the polymer P-2 of interest (yield 98%).

It is possible to use a combination of two or more of the imidazole polymers of the present invention described above.

A preferable range of the molecular weight or the degree of polymerization of the imidazole polymer of the present invention varies depending on the type or the properties of an emulsion to which the polymer is applied or the structure of the polymer. However, the molecular weight is preferably 5,000 to 1,000,000, and most preferably 10,000 to 500,000.

The imidazole compound of the present invention can be added to a silver halide emulsion at any appropriate time. More specifically, the imidazole compound can be added to a silver halide emulsion during grain formation, before, during or after chemical sensitization, or immediately before coating. In the case of a silver halide photographic light-sensitive material having a plurality of layers, it is also possible to add the imidazole compound not to an emulsion layer containing the substantially perfect cubes of the present invention but to other layer or layers.

Although the addition amount of the imidazole compound may vary depending on the perfection ratio and the grain size of the cubic emulsion and the addition timing, it is preferably $1\times10^{-5}$ to $1\times10^{-1}$ mol per mol of silver halide. When the imidazole compound is added during grain formation, it is added excessively, preferably in an amount of $1\times10^{-4}$ to 1 mol per mol of silver halide, since a larger amount of the compound is washed away during subsequent washing step.

The imidazole compound can be added in the form of an aqueous solution, in the form of an acidic aqueous solution, in the form of an alkaline aqueous solution, in the form of a solution in an organic solvent, such as methanol, directly in the form of a powder, or in the form of a molecular dispersion together with gelatin.

Photographic emulsions used in the present invention can be prepared by the methods described in, e.g., P. Glafkides, Chimie et Physique Photographique, Paul Montel, 1967; G. F. Duffin, Photographic Emulsion Chemistry, Focal Press, 1966; and V. L. Zelikman et al., Making and Coating Photographic Emulsion, Focal Press, 1964. That is, any of an acid method, a neutral method, and an ammonia method can be used. In forming grains by a reaction of a soluble silver salt and a soluble halogen salt, any of a single-jet method, a double-jet method, and a combination of these methods can be used. It is also possible to use a method (so-called reverse double-jet method) of forming grains in the presence of excess silver ions. As one type of the double-jet method, a method in which the pAg of a liquid phase for producing a silver halide is maintained constant, i.e., a so-called controlled double-jet method can be used. This method makes it possible to obtain a silver halide emulsion in which a crystal shape is regular and a grain size is nearly uniform.

In some cases, it is preferable to make use of a method of adding silver halide grains already formed by precipitation to a reactor vessel for emulsion preparation, and the methods described in U.S. Pat. Nos. 4,334,012, 4,301,241, and 4,150,994. These silver halide grains can be used as seed crystal and are also effective as a silver halide for growth. In the latter case, addition of an emulsion with a small grain size is preferable. The total amount of an emulsion can be added at one time, or an emulsion can be separately added a plurality of times or added continuously. In addition, it is sometimes effective to add grains having several different halogen compositions in order to modify the surface.

A method of converting most of or only a part of the halogen composition of a silver halide grain by a halogen conversion process is disclosed in, e.g., U.S. Pat. Nos. 3,477,852 and 4,142,900, EP 273,429 and EP 273,430, and West German Patent 3,819,241. This method is an effective grain formation method. To convert into a silver salt that is more sparingly soluble, it is possible to add a solution or silver halide grains of a soluble halogen. The conversion can be performed at one time, separately a plurality of times, or continuously.

As a grain growth method other than the method of adding a soluble silver salt and a halogen salt at a constant concentration and a constant flow rate, it is preferable to use a grain formation method in which the concentration or the flow rate is changed, such as described in British Patent 1,469,480 and U.S. Pat. Nos. 3,650,757 and 4,242,445. Increasing the concentration or the flow rate can change the amount of a silver halide to be supplied as a linear function, a quadratic function, or a more complex function of the addition time. It is also preferable to decrease the silver halide amount to be supplied if necessary depending on the situation. Furthermore, when a plurality of soluble silver salts of different solution compositions are to be added or a plurality of soluble halogen salts of different solution compositions are to be added, a method of increasing one of the salts while decreasing the other is also effective.

A mixing vessel for reacting solutions of soluble silver salts and soluble halogen salts can be selected from those described in U.S. Pat. Nos. 2,996,287, 3,342,605, 3,415,650, and 3,785,777 and West German Patents 2,556,885 and 2,555,364.

A silver halide solvent is useful for the purpose of accelerating ripening. As an example, it is known to make an excess of halogen ion exist in a reactor vessel in order to accelerate ripening. Another ripening agent can also be used. The total amount of these ripening agents can be mixed in a dispersing medium placed in a reactor vessel before addition of silver and a halide salt, or can be introduced to the reactor vessel simultaneously with addition of a halide salt, a silver salt or a deflocculant. Alternatively, ripening agents can be independently added in the step of adding a halide salt and a silver salt.

Examples of the ripening agent are ammonia, a thiocyanate salt (e.g., potassium rhodanate and ammonium rhodanate), an organic thioether compound (e.g., compounds described in U.S. Pat. Nos. 3,574,628, 3,021,215, 3,057,724, 3,038,805, 4,276,374, 4,297,439, 3,704,130, and 4,782,013 and JP-A-57-104926), a thione compound (e.g., 4-substituted thioureas described in JP-A-53-82408, JP-A-55-77737 and U.S. Pat. No. 4,221,863, and compounds described in JP-A-53-144319), a mercapto compound capable of accelerating growth of silver halide grains, described in JP-A-57-202531, and an amine compound (e.g., JP-A-54-100717).

It is advantageous to use gelatin as a protective colloid for use in preparation of emulsions of the present invention or as a binder for other hydrophilic colloid layers. However, other hydrophilic colloids can also be used in place of gelatin.

Examples of the hydrophilic colloid are protein, such as a gelatin derivative, a graft polymer of gelatin and another high polymer, albumin, and casein; a cellulose derivative, such as hydroxyethylcellulose, carboxymethylcellulose and cellulose sulfates, and a sugar derivative such as sodium alginate and a starch derivative; and a variety of synthetic hydrophilic high polymers, such as homopolymers or copolymers, e.g., polyvinyl alcohol, polyvinyl alcohol partial acetal, poly-N-vinylpyrrolidone, polyacrylic acid, polymethacrylic acid, polyacrylamide, polyvinylimidazole, and polyvinyl pyrazole.

Examples of gelatin are lime-processed gelatin, acid-processed gelatin, and enzyme-processed gelatin described in Bull. Soc. Sci. Photo. Japan. No. 16, page 30 (1966). In addition, a hydrolyzed product or an enzyme-decomposed product of gelatin can also be used.

In the preparation of an emulsion of the present invention, it is preferable to make a salt of metallic ions exist during grain formation, desalting, or chemical sensitization, or before coating in accordance with the intended use. The metal ion salt is preferably added during grain formation in doping grains therewith, and after grain formation and before completion of chemical sensitization in modifying the grain surface or when used as a chemical sensitizer. The doping can be performed for an overall grain, only the core, the shell or the epitaxial portion of a grain, or only a substrate grain. Examples of the metal are Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi. These metals can be added as long as they are in the form of salt that can be dissolved during grain formation, such as an ammonium salt, an acetate salt, a nitrate salt, a sulfate salt, a phosphate salt, a hydroxide salt, a 6-coordinated complex salt, or a 4-coordinated complex salt. Examples are $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, and $K_4Ru(CN)_6$. The legand of a coordination compound can be selected from halo, aquo, cyano, cyanate, thiocyanate, nitrosyl, thionitrosyl, oxo, and carbonyl. These metal compounds can be used either singly or in combination of two or more types of them.

In the present invention, the use of an iridium compound is particularly preferred. Preferable examples of the iridium compound are water-soluble iridium salt and complex compound. More preferable examples of the iridium compound are iridium trichloride, iridium tetrachloride, and sodium, potassium or ammonium hexachloroiridate (III) or (IV).

The amount of the iridium compound is preferably $1\times10^{-10}$ to $1\times10^{-4}$ mol, and more preferably $1\times10^{-9}$ to $1\times10^{-6}$ mol per mol of silver halide.

The above-noted metal compounds are preferably dissolved in an appropriate solvent, such as water, or methanol or acetone, and added in the form of a solution. To stabilize the solution, an aqueous hydrogen halide solution (e.g., HCl and HBr) or an alkali halide (e.g., KCl, NaCl, Kbr, and NaBr) can be added. It is also possible to add acid or alkali if necessary. The metal compounds can be added to a reactor vessel either before or during grain formation. Alternatively, the metal compounds can be added to a water-soluble silver salt (e.g., $AgNO_3$) or an aqueous alkali halide solution (e.g., NaCl, KBr, and KI) and added in the form of a solution continuously during formation of silver halide grains. Furthermore, a solution of the metal compounds can be prepared independently of a water-soluble silver salt or an alkali halide and added continuously at a proper timing during grain formation. It is also possible to combine several different addition methods.

It is sometimes useful to add a chalcogen compound during preparation of an emulsion, such as described in U.S. Pat. No. 3,772,031. In addition to S, Se or Te, a cyanate salt, a thiocyanate salt, a selenocyanate salt, a carbonate salt, a phosphate salt, or an acetate salt can be present.

In formation of silver halide grains of the present invention, at least one of sulfur sensitization, selenium sensitization, noble metal sensitization such as gold or palladium sensitization, and reduction sensitization can be performed at any point during the process of manufacturing a silver halide emulsion. The use of two or more different sensitizing methods is preferable. Several different types of emulsions can be prepared by changing the timing at which the chemical sensitization is performed. The emulsion types are classified into: a type in which a chemical sensitization speck is embedded inside a grain, a type in which it is embedded at a shallow position from the surface of a grain, and a type in which it is formed on the surface of a grain. In emulsions of the present invention, the location of a chemical sensitization speck can be selected in accordance with the intended use. It is, however, generally preferable to form at least one type of a chemical sensitization speck near the surface.

One chemical sensitization which can be preferably performed in the present invention is chalcogen sensitization, noble metal sensitization, or a combination of these. The sensitization can be performed by using an active gelation as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers, at pAg 5 to 10, pH 5 to 8, and a temperature of 30° to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent 1,315,755. In the noble metal sensitization, salts of noble metals, such as gold, platinum, palladium, and iridium, can be used. In particular, gold sensitization, palladium sensitization, or a combination of the both is preferable. In the gold sensitization, it is possible to use known gold compounds, such as chloroauric acid, potassium chloroaurate, potassium aurithiocyanate, gold sulfide, and gold selenide. A palladium compound means a salt of palladium (II) or (IV). A preferable palladium compound is represented by $R_2PdX_6$ or $R_2PdX_4$ wherein R represents a hydrogen atom, an alkali metal atom or an ammonium group, and X represents a halogen atom, i.e., a chlorine, bromine, or iodine atom.

More specifically, the palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable that the gold compound and the palladium compound be used in combination with a thiocyanate salt or a selenocyanate salt.

Examples of a sulfur sensitizer are hypo, a thiourea-based compound, a rhodanine-based compound, and sulfur-containing compounds described in U.S. Pat. Nos. 3,857,711, 4,266,018, and 4,054,457. The chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of the chemical sensitization aid and the modifier are described in U.S. Pat. Nos. 2,131,038, 3,411,914, and 3,554,757, JP-A-58-126526, and G. F. Duffin, Photographic Emulsion Chemistry, pages 138 to 143.

It is preferable to also perform gold sensitization for emulsions of the present invention. An amount of a gold sensitizer is preferably $1\times10^{-4}$ to $1\times10^{-7}$ mole, and more preferably $1\times10^{-5}$ to $5\times10^{-7}$ mole per mole of silver halide. A preferable amount of a palladium compound is $1\times10^{-3}$ to $5\times10^{-7}$. A preferable amount of a thiocyan compound or a selenocyan compound is $5\times10^{-2}$ to $1\times10^{-6}$ per mole of silver halide.

An amount of a sulfur sensitizer with respect to silver halide grains of the present invention is preferably $1\times10^{-4}$ to $1\times10^{-7}$ mole, and more preferably $1\times10^{-5}$ to $5\times10^{-7}$ mole per mole of silver halide.

Selenium sensitization is a preferable sensitizing method for emulsions of the present invention. Known labile selenium compounds are used in the selenium sensitization. Practical examples of the selenium compound are colloidal metallic selenium, selenoureas (e.g., N,N-dimethylselenourea and N,N-diethylselenourea), selenoketones, and selenoamides. In some cases, it is preferable to perform the selenium sensitization in combination with one or both of the sulfur sensitization and the noble metal sensitization.

Silver halide emulsions of the present invention are preferably subjected to reduction sensitization during grain formation, after grain formation and before or during chemical sensitization, or after chemical sensitization.

The reduction sensitization can be selected from a method of adding reduction sensitizers to a silver halide emulsion, a method called silver ripening in which grains are grown or ripened in a low-pAg environment at pAg 1 to 7, and a method called high-pH ripening in which grains are grown or ripened in a high-pH environment at pH 8 to 11. It is also possible to perform two or more of these methods together.

The method of adding reduction sensitizers is preferable in that the level of reduction sensitization can be finely adjusted.

Known examples of the reduction sensitizer are stannous chloride, ascorbic acid and its derivative, amines and polyamines, a hydrazine derivative, formamidinesulfinic acid, a silane compound, and a borane compound. In the reduction sensitization of the present invention, it is possible to selectively use these known reduction sensitizers or to use two or more types of compounds together. Preferable compounds as the reduction sensitizer are stannous chloride, thiourea dioxide, dimethylamineborane, and ascorbic acid and its derivative. Although an addition amount of the reduction sensitizers must be so selected as to meet the emulsion manufacturing conditions, a preferable amount is $10^{-7}$ to $10^{-3}$ mole per mole of silver halide.

The reduction sensitizers are dissolved in water or an organic solvent, such as alcohols, glycols, ketones, esters or amides, and the resultant solution is added during grain growth. Although adding to a reactor vessel in advance is also preferable, adding at a given timing during grain growth is more preferable. It is also possible to add the reduction sensitizers to an aqueous solution of a water-soluble silver salt or a water-soluble alkali halide to precipitate silver halide grains by using this aqueous solution. Alternatively, a solution of the reduction sensitizers may be added separately several times or continuously over a long time period with grain growth.

Photographic emulsions used in the present invention may contain various compounds in order to prevent fog during the manufacturing process, storage, or photographic treatments of a light-sensitive material, or to stabilize photographic properties. Usable compounds are those known as an antifoggant or a stabilizer, for example, thiazoles, such as benzothiazolium salt, nitroimidazoles, nitrobenzimidazoles, chlorobenzimidazoles, bromobenzimidazoles, mercaptothiazoles, mercaptobenzothiazoles, mecaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxadolinethione; azaindenes, such as triazaindenes, tetrazaindenes (particularly hydroxy-substituted(1,3,3*a*,7)tetrazaindenes), and pentazaindenes. For example, compounds described in U.S. Pat. Nos. 3,954,474 and 3,982,947 and JP-B-52-28660 can be used. One preferable compound is described in JP-A-63-212932. Antifoggants and stabilizers can be added at any of several different timings, such as before, during, and after grain formation, during washing with water, during dispersion after the washing, before, during, and after chemical sensitization, and before coating, in accordance with the intended application. The antifoggants and the stabilizers can be added during preparation of an emulsion to achieve their original fog preventing effect and stabilizing effect. In addition, the antifoggants and the stabilizers can be used for various purposes of, e.g., controlling crystal habit of grains, decreasing a grain size, decreasing the solubility of grains, controlling chemical sensitization, and controlling an arrangement of dyes.

A various compounds can be used in the light-sensitive material of the invention, as described above. The other additives or compounds can be used in accordance with intended use.

These additives are described in detail in Reseach Disclosure Items 17643 (December 1978), 18716 (November 1979) and 308119 (December 1989) and are listed below:

| Additives | RD17643 | RD18716 | RD308119 |
|---|---|---|---|
| 1. Chemical sensitizers | page 23 | page 648, right column | page 996 |
| 2. Sensitivity-increasing agents | | page 648, right column | |
| 3. Spectral sensitizers, super-sensitizers | page 23–24 | page 648, right column to page 649, right column | page 996, right column to page 998, right column |
| 4. Brighteners | page 24 | | page 998, right column |
| 5. Antifoggants, stabilizers | page 24–25 | page 649, right column | page 998, right column to page 1000, right column |
| 6. Light absorbent, filter dye, ultra-violet absorbents | page 25–26 | page 649, right column to page 650, left column | page 1003, left column to page 1003, right column |
| 7. Stain-preventing agents | page 25, right column | page 650, left-right columns | page 1002, right column |
| 8. Dye image-stabilizer | page 25 | | page 1002, right column |
| 9. Hardening agents | page 26 | page 651, left column | page 1004, right column to page 1005, left column |
| 10. Binder | page 26 | page 651, left column | page 1003, right column to page 1004, right column |
| 11. Plasticizers, lubricants | page 27 | page 650, right column | page 1006, left-right columns |
| 12. Coating aids, surface active agents | page 26–27 | page 650, right column | page 1005, left column to page 1006, right column |
| 13. Antistatic agents | page 27 | page 650, right column | page 1006, right column to page 1007, left column |
| 14. Matting agent | | | page 1008, left column to page 1009, left column |

The light-sensitilve material of tahe present invention needs only to have at least one of silver halide emulsion layers, i.e., a blue-sensitive layer, a green-sensitive layer, and a red-sensitive layer, formed on a support. The number or order of the silver halide emulsion layers and the non-light-sensitive layers are particularly not limited. A typical example is a silver halide photographic light-sensitive material having, on a support, at least one unit light-sensitive layer constituted by a plurality of silver halide emulsion layers which are sensitive to essentially the same color but have different sensitivities or speeds. The unit light-sensitive layer is sensitive to blue, green or red light. In a multi-layered silver halide color photographic light-sensitive material, the unit light-sensitive layers are generally arranged such that red-, green-, and blue-sensitive layers are formed from a support side in the order named. However, this order may be reversed or a layer having a different color sensitivity may be sandwiched between layers having the same color sensitivity in accordance with the application.

Non-light-sensitive layers such as various types of interlayers may be formed between the silver halide light-sensitive layers and as the uppermost layer and the lowermost layer.

The interlayer may contain, e.g., couplers and DIR compounds as described in JP-A-61-43748, JP-A-59-113438, JP-A-59-113440, JP-A-61-20037, and JP-A-61-20038 or a color mixing inhibitor which is normally used.

As a plurality of silver halide emulsion layers constituting each unit light-sensitive layer, a two-layered structure of high- and low-speed emulsion layers can be preferably used as described in West German Patent 1,121,470 or British Patent 923,045. In this case, layers are preferably arranged such that the sensitivity or speed is sequentially decreased toward a support, and a non-light-sensitive layer may be formed between the silver halide emulsion layers. In addition, as described in JP-A-57-112751, JP-A-62-200350, JP-A-62-206541, and JP-A-62-206543, layers may be arranged such that a low-speed emulsion layer is formed remotely from a support and a high-speed layer is formed close to the support.

More specifically, layers may be arranged from the farthest side from a support in an order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), an order of BH/BL/GL/GH/RH/RL, or an order of BH/BL/GH/GL/RL/RH.

In addition, as described in JP-B-55-34932, layers may be arranged from the farthest side from a support in an order of blue-sensitive layer/GH/RH/GL/RL. Furthermore, as described in JP-A-56-25738 and JP-A-62-63936, layers may be arranged from the farthest side from a support in an order of blue-sensitive layer/GL/RL/GH/RH.

As described in JP-B-49-15495, three layers may be arranged such that a silver halide emulsion layer having the highest sensitivity is arranged as an upper layer, a silver halide emulsion layer having sensitivity lower than that of the upper layer is arranged as an intermediate layer, and a silver halide emulsion layer having sensitivity lower than that of the intermediate layer is arranged as a lower layer. In other words, three layers having different sensitivities may be arranged such that the sensitivity is sequentially decreased toward the support. When a layer structure is constituted by three layers having different sensitivities or speeds, these layers may be arranged in an order of medium-speed emulsion layer/high-speed emulsion layer/low-speed emulsion layer from the farthest side from a support in a layer having the same color sensitivity as described in JP-A-59-202464.

Also, an order of high-speed emulsion layer/low-speed emulsion layer/medium-speed emulsion layer, or low-speed emulsion layer/medium-speed emulsion layer/high-speed emulsion layer may be adopted. Furthermore, the arrangement can be changed as described above even when four or more layers are formed.

As described above, various layer configurations and arrangements can be selected in accordance with the application of the light-sensitive material.

In the present invention, a non-light-sensitive fine grain silver halide is preferably used. The non-light-sensitive fine grain silver halide means silver halide fine grains not sensitive upon imagewise exposure for obtaining a dye image and essentially not developed in development. The non-light-sensitive fine grain silver halide is preferably not fogged beforehand.

The fine grain silver halide contains 0 to 100 mol % of silver bromide and may contain silver chloride and/or silver iodide as needed. Preferably, the fine grain silver halide contains 0.5 to 10 mol % of silver iodide.

An average grain size (an average value of equivalent-circle diameters of projected areas) of the fine grain silver halide is preferably 0.01 to 0.5 μm, and more preferably, 0.02 to 0.2 μm.

The fine grain silver halide can be prepared by a method similar to a method of preparing normal light-sensitive silver halide. In this preparation, the surface of a silver halide grain need not be subjected to either chemical sensitization or spectral sensitization. However, before the silver halide grains are added to a coating solution, a known stabilizer such as a triazole compound, an azaindene compound, a benzothiazolium compound, a mercapto compound, or a zinc compound is preferably added. This fine grain silver halide grain-containing layer preferably contains colloidal silver.

The light-sensitive material of the present invention preferably contains a mercapto compound described in U.S. Pat. Nos. 4,740,454 and 4,788,132, JP-A-62-18539, and JP-A-1-283551.

The light-sensitive material of the present invention preferably contains compounds which release, regardless of a developed silver amount produced by the development, a fogging agent, a development accelerator, a silver halide solvent, or precursors thereof, described in JP-A-1-106052.

The light-sensitive material of the present invention preferably contains dyes dispersed by methods described in International Disclosure WO 88/04794 and JP-A-1-502912, or dyes described in European Patent 317,308A, U.S. Pat. No. 4,420,555, and JP-A-1-259358.

Various color couplers can be used in the present invention, and specific examples of these couplers are described in patents described in the above-mentioned RD No. 17643, VII-C to VII-G and RD No. 307105, VII-C to VII-G.

Preferable examples of yellow couplers are described in, e.g., U.S. Pat. Nos. 3,933,501; 4,022,620; 4,326,024; 4,401,752 and 4,248,961, JP-B-58-10739, British Patents 1,425,020 and 1,476,760, U.S. Pat. Nos. 3,973,968; 4,314,023 and 4,511,649, and European Patent 249,473A.

Examples of a magenta coupler are preferably 5-pyrazolone type and pyrazoloazole type compounds, and more preferably, compounds described in, for example, U.S. Pat. Nos. 4,310,619 and 4,351,897, European Patent 73,636, U.S. Pat. Nos. 3,061,432 and 3,725,067, RD No. 24220 (June 1984), JP-A-60-33552, RD No. 24230 (June 1984), JP-A-60-43659, JP-A-61-72238, JP-A-60-35730, JP-A-55-118034, JP-A-60-185951, U.S. Pat. Nos. 4,500,630; 4,540,654 and 4,556,630, and WO No. 88/04795.

Examples of a cyan coupler are phenol type and naphthol type ones. Of these, preferable are those described in, for example, U.S. Pat. Nos. 4,052,212; 4,146,396; 4,228,233; 4,296,200; 2,369,929; 2,801,171; 2,772,162; 2,895,826; 3,772,002; 3,758,308; 4,343,011 and 4,327,173, West German Patent Laid-open Application 3,329,729, European Patents 121,365A and 249,453A, U.S. Pat. Nos. 3,446,622; 4,333,999; 4,775,616; 4,451,559; 4,427,767; 4,690,889; 4,254,212 and 4,296,199, and JP-A-61-42658. Also, the pyrazoloazole type couplers disclosed in JP-A-64-553, JP-A-64-554, JP-A-64-555 and JP-A-64-556, and imidazole type couplers disclosed in U.S. Pat. No. 4,818,672 can be used as cyan coupler in the present invention.

Typical examples of a polymerized dye-forming coupler are described in, e.g., U.S. Pat. Nos. 3,451,820; 4,080,211; 4,367,282; 4,409,320 and 4,576,910, British Patent 2,102,173, and European Patent 341,188A.

Preferable examples of a coupler capable of forming colored dyes having proper diffusibility are those described in U.S. Pat. No. 4,366,237, British Patent 2,125,570, European Patent 96,570, and West German Laid-open Patent Application No. 3,234,533.

Preferable examples of a colored coupler for correcting unnecessary absorption of a colored dye are those described in RD No. 17643, VII-G, RD No. 30715, VII-G, U.S. Pat. No. 4,163,670, JP-B-57-39413, U.S. Pat. Nos. 4,004,929 and 4,138,258, and British Patent 1,146,368. A coupler for correcting unnecessary absorption of a colored dye by a fluorescent dye released upon coupling described in U.S. Pat. No. 4,774,181 or a coupler having a dye precursor group which can react with a developing agent to form a dye as a split-off group described in U.S. Pat. No. 4,777,120 may be preferably used.

Those compounds which release a photographically useful residue upon coupling may also be preferably used in the present invention. DIR couplers, i.e., couplers releasing a development inhibitor, are preferably those described in the patents cited in the above-described RD No. 17643, VII-F and RD No. 307105, VII-F, JP-A-57-151944, JP-A-57-154234, JP-A-60-184248, JP-A-63-37346, JP-A-63-37350, and U.S. Pat. Nos. 4,248,962 and 4,782,012.

Preferable examples of a coupler which imagewise releases a nucleating agent or a development accelerator are those described in British Patents 2,097,140 and 2,131,188, JP-A-59-157638, and JP-A-59-170840. In addition, compounds releasing, e.g., a fogging agent, a development accelerator or a silver halide solvent upon redox reaction with an oxidized form of a developing agent, described in JP-A-60-107029, JP-A-60-252340, JP-A-1-44940, and JP-A-1-45687, can also be preferably used.

Examples of other compounds which can be used in the light-sensitive material of the present invention are competing couplers described in, for example, U.S. Pat. No. 4,130,427; poly-equivalent couplers described in, e.g., U.S. Pat. Nos. 4,283,472, 4,338,393, and 4,310,618; a DIR redox compound-releasing coupler, a DIR coupler-releasing coupler, a DIR coupler releasing redox compound, or a DIR redox-releasing redox compound described in, for example, JP-A-60-185950 and JP-A-62-24252; couplers releasing a dye which restores color after being released described in European Patent 173,302A and 313,308A; a bleaching accelerator-releasing coupler described in, e.g., RD No. 11449 and 24241, and JP-A-61-201247; a ligand-releasing coupler described in, e.g., U.S. Pat. No. 4,553,477; a coupler releasing a leuco dye described in JP-A-63-75747; and a coupler releasing a fluorescent dye described in U.S. Pat. No. 4,774,181.

The couplers for use in this invention can be introduced into the light-sensitive material by various known dispersion methods.

Examples of a high-boiling point organic solvent to be used in the oil-in-water dispersion method are described in, e.g., U.S. Pat. No. 2,322,027.

An organic solvent having a boiling point of about 30° C. or more, and preferably, 50° C. to about 160° C. can be used as an auxiliary solvent. Typical examples of the auxiliary solvent are ethyl acetate, butyl acetate, ethyl propionate, methylethylketone, cyclohexanone, 2-ethoxyethyl acetate, and dimethylformamide.

Steps and effects of a latex dispersion method and examples of a immersing latex are described in, e.g., U.S. Pat. No. 4,199,363 and German Laid-open Patent Application (OLS) Nos. 2,541,274 and 2,541,230.

Various types of antiseptics and fungicides agent are preferably added to the color light-sensitive material of the present invention. Typical examples of the antiseptics and the fungicides are phenethyl alcohol, and 1,2-benzisothiazolin-3-one, n-butyl p-hydroxybenzoate, phenol, 4-chloro-3,5-dimethylphenol, and 2-phenoxyethanol, which are described in JP-A-63-257747, JP-A-62-272248, and JP-A-1-80941.

The present invention can be applied to various color light-sensitive materials. Typical examples of the material are a color negative film for a general purpose or a movie, a color reversal film for a slide or a television, a color paper, a color positive film, and a color reversal paper.

A support which can be suitably used in the present invention is described in, e.g., RD. No. 17643, page 28, RD. No. 18716, from the right column, page 647 to the left column, page 648, and RD. No. 307105, page 879.

In the light-sensitive material of the present invention, the sum total of film thicknesses of all hydrophilic colloidal layers at the side having emulsion layers is preferably 28 μm or less, more preferably, 23 μm or less, much more preferably, 18 μm or less, and most preferably, 16 μm or less. A film swell speed $T_{1/2}$ is preferably 30 seconds or less, and more preferably, 20 seconds or less. The film thickness means a film thickness measured under moisture conditioning at a temperature of 25° C. and a relative humidity of 55% (two days). The film swell speed $T_{1/2}$ can be measured in accordance with a known method in the art. For example, the film swell speed $T_{1/2}$ can be measured by using a swellometer described by A. Green et al. in Photographic Science & Engineering, Vol. 19, No. 2, pp. 124 to 129. When 90% of a maximum swell film thickness reached by performing a treatment by using a color developer at 30° C. for 3 minutes and 15 seconds is defined as a saturated film thickness, $T_{1/2}$ is defined as a time required for reaching ½ of the saturated film thickness.

The film swell speed $T_{1/2}$ can be adjusted by adding a film hardening agent to gelatin as a binder or changing aging conditions after coating. A swell ratio is preferably 150% to 400%. The swell ratio is calculated from the maximum swell film thickness measured under the above conditions in accordance with a relation:

(maximum swell film thickness - film thickness)/film thickness.

In the light-sensitive material of the present invention, a hydrophilic colloid layer (called back layer) having a total dried film thickness of 2 to 20 μm is preferably formed on the side opposite to the side having emulsion layers. The back layer preferably contains, e.g., the light absorbent, the filter dye, the ultraviolet absorbent, the antistatic agent, the film hardener, the binder, the plasticizer, the lubricant, the coating aid, and the surfactant, described above. The swell ratio of the back layer is preferably 150% to 500%.

The color photographic light-sensitive material according to the present invention can be developed by conventional methods described in RD. No. 17643, pp. 28 and 29, RD. No. 18716, the left to right columns, page 651, and RD. No. 307105, pp. 880 and 881.

The silver halide color light-sensitive material of the present invention exerts its advantages more effectively when applied to a film unit equipped with a lens disclosed in JP-B-2-32615 or Examined Published Japanese Utility Model Application (JU-B) 3-39784.

The present invention will be described in greater detail below by way of its examples, but the invention is not limited to these examples.

EXAMPLE 1

<Preparation of seed crystals 1>

1 kg of gelatin was dissolved in 25 liters of water, and the pH was adjusted to 5.7. To the solution, at 45° C., 5.2 liters of an aqueous 13.5% silver nitrate solution and 5.2 liters of an aqueous 10.2% potassium bromide solution were added at a rate of 100 cc/min for ten minutes and 600 cc/min for seven minutes. In addition, an aqueous solution containing 2,250 g of silver nitrate was added to the resultant solution over 68 minutes while the addition amount was increased by 7.5 cc per minute. Simultaneously, an aqueous potassium bromide solution was added to maintain the pAg at 6.7. The resultant emulsion was washed with water by a coagulation sedimentation process while the pAg was kept at 7.2, and 475 g of gelatin were added to redisperse the emulsion. As a result, seed crystals 1 were obtained, having an equivalent-sphere diameter of 0.14 μm. The yield was 20 kg.

When the perfection ratio of this seed crystal emulsion was measured, the emulsion was found to be a cubic emulsion with a perfection ratio of 0.975.

<Preparation of emulsions 1A-1 and 1A-2>

45 g of the seed crystals 1 and 45 g of gelatin were dispersed in 1,450 cc of water at 70° C., and the pH was adjusted to 6.5. 1,000 cc of an aqueous 1.542M silver nitrate solution and an aqueous solution mixture of potassium bromide and potassium iodide, that contained 2 mol % of iodide, were added over 60 minutes while controlling the pAg to 9.0. Note that the addition rate was increased linearly with respect to time such that the final addition rate was 12.755 times that at the beginning. Subsequently, sensitizing dyes S-1, S-2 and S-3 indicated below were added in amounts of $5.4\times10^{-4}$, $2.0\times10^{-4}$ mol, and $0.4\times10^{-4}$ mol, respectively, per mol of silver, and the mixture was ripened for 20 minutes.

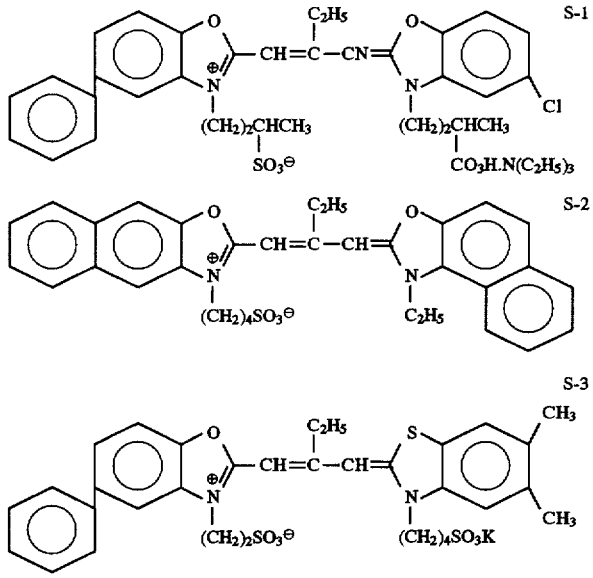

At a temperature of 35° C., the resultant emulsion was washed with water by a coagulation sedimentation process using a water-soluble polymer such that the concentration of water-soluble salt was 1/200 while controlling the pAg to 7.5. 100 g of gelatin were added to redisperse the emulsion under conditions of pAg=8.4 and pH=6.4. As a result, an octahedral emulsion was obtained, having an equivalent-sphere diameter of 0.50 μm.

Subsequently, this non-after-ripened emulsion was divided into two portions. One portion of the emulsion was heated up to 55° C. and added with potassium thiocyanate in an amount of $1\times10^{-3}$ mol per mol of silver. Thereafter, chemical sensitization was performed optimally by adding chloroauric acid, sodium thiosulfate and dimethylselenourea, yielding an emulsion 1A-1.

The other portion was added with benzimidazole (exemplified compound BI-1) in an amount of 0.002 mol per mol of silver halide and chemically sensitized following the same procedures as for the emulsion 1A-1, yielding an emulsion 1A-2.

<Preparation of emulsions 1B-1 and 1B-2>

Emulsions 1B-1 and 1B-2 were prepared following the same procedures as for the emulsions 1A-1 and 1A-2 except that the addition of an aqueous silver nitrate solution was performed while the pAg was controlled to 8.0 during grain formation. As a result, tetradecahedral grains were obtained, in each of which a (111) face and a (100) face had nearly the same areas. The emulsion 1B-2 contained BI-1 (benzimidazole).

<Preparation of emulsions 1C-1 and 1C-2>

Emulsions 1C-1 and 1C-2 were prepared following the same procedures as for the emulsions 1A-1 and 1A-2 except that the addition of an aqueous silver nitrate solution was performed while the pAg was controlled to 7.0 during grain formation. As a result, tetradecahedral grains were obtained, in which (100) faces were dominant. The perfection ratio was found to be 0.645. The emulsion 1C-2 contained BI-1.

<Preparation of emulsions 1D-1 and 1D-2>

Emulsions 1D-1 and 1D-2 were prepared following the same procedures as for the emulsions 1A-1 and 1A-2 except that the addition of an aqueous silver nitrate solution was performed while the pAg was controlled to 6.6 during grain formation. As a result, cubic emulsions were obtained, having a perfection ratio of 0.856. The emulsion 1D-2 contained BI-1.

<Preparation of emulsions 1E-1, 1E-2, and 1E-3>

Emulsions 1E-1, 1E-2, and 1E-3 were prepared following the same procedures as for the emulsions 1A-1 and 1A-2 except that the addition of an aqueous silver nitrate solution was performed while the pAg was controlled to 6.3 during grain formation and an aqueous 0.6M silver nitrate solution was used in order to stabilize the control. The addition flow rate was controlled such that the addition amount of silver nitrate per unit time was the same as in the case of the emulsions 1A. As a result, cubic emulsions were obtained, having a perfection ratio of 0.968. The emulsion 1E-1 contained no BI-1. The emulsions 1E-2 and 1E-3 contained BI-1 in amounts of 0.0005 mol and 0.002 mol, respectively, per mol of silver.

<Preparation of emulsions 1F-1, 1F-2, and 1F-3>

Emulsions 1F-1, 1F-2, and 1F-3 were prepared following the same procedures as for the emulsions 1A-1 and 1A-2 except that the addition of an aqueous silver nitrate solution was performed while the pAg was controlled to 5.7 during grain formation and an aqueous 0.6M silver nitrate solution was used in order to stabilize the control. The addition flow rate was controlled such that the addition amount of silver nitrate per unit time was ¼ that in the case of the emulsions 1A. As a result, cubic emulsions were obtained, having a perfection ratio of 0.997. The emulsion 1F-1 contained no BI-1. The emulsions 1F-2 and 1F-3 contained BI-1 in amounts of 0.0005 mol and 0.002 mol, respectively, per mol of silver.

The spectrally sensitized emulsions 1A-1 to 1F-3 prepared as described above were coated on TAC (triacetyl cellulose) supports under the coating conditions below.

Emulsion Coating Conditions (1) Emulsion layer Emulsion . . . each spectrally sensitized emulsion (silver content $2.1\times10^{-2}$ mol/m$^2$) Coupler indicated below ($1.5\times10^{-3}$ mol/m$^2$)

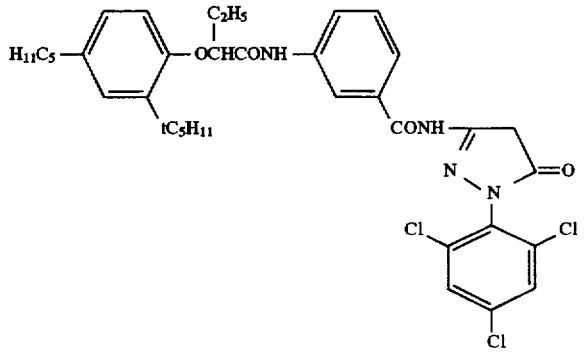

Tricresylphosphate (1.10 g/m$^2$) Gelatin (2.3 g/m$^2$)

(2) Protective layer 2,4-dichloro-6-hydroxy-s-triazine sodium salt (0.08 g/m$^2$) Gelatin (1.8 g/m$^2$)

These samples were left to stand at a temperature of 40° C. and a relative humidity of 70% for 14 hours, exposed through a yellow filter (available from Fuji Photo Film Co., Ltd.) and a continuous wedge for 1/100 second and 1/10000 second, and subjected to the following color development.

(Processing method)

| Step | Time | | Temperature |
|---|---|---|---|
| Color development | 2 min. | 45 sec. | 38° C. |
| Bleaching | 3 min. | 00 sec. | 38° C. |
| Washing | | 30 sec. | 24° C. |
| Fixing | 3 min. | 00 sec. | 38° C. |
| Washing (1) | | 30 sec. | 24° C. |
| Washing (2) | | 30 sec. | 24° C. |
| Stabilization | | 30 sec. | 38° C. |
| Drying | 4 min. | 20 sec. | 55° C. |

The compositions of the individual processing solutions are given below.

| | (g) |
|---|---|
| (Color developing solution) | |
| Diethylenetriaminepentaacetic acid | 1.0 |
| 1-hydroxyethylidene-1,1-diphosphonic acid | 3.0 |
| Sodium sulfite | 4.0 |
| Potassium carbonate | 30.0 |
| Potassium bromide | 1.4 |
| Potassiuim iodide | 1.5 mg |
| Hydroxylamine sulfate | 2.4 |
| 4-[N-ethyl-N-β-hydroxylethylamino]-2-methylaniline sulfate | 4.5 |
| Water to make | 1.0 l |
| pH | 10.05 |
| (Bleaching solution) | |
| Ferric ammonium ethylenediamine-tetraacetate trihydrate | 100.0 |
| Disodium ethylenediaminetetraacetate | 10.0 |
| 3-mercapto-1,2,4-triazole | 0.08 |
| Ammonium bromide | 140.0 |
| Ammonium nitrate | 30.0 |
| Ammonia water (27%) | 6.5 ml |
| Water to make | 1.0 l |
| pH | 6.0 |
| (Fixing solution) | |
| Disodium ethylenediaminetetraacetate | 0.5 |
| Ammonium sulfite | 20.0 |
| Ammonium thiosulfate | 290.0 ml |

-continued

| | (g) |
|---|---|
| aqueous solution (700 g/l) | |
| Water to make | 1.0 l |
| pH | 6.7 |
| (Stabilizing solution) | |
| Sodium p-toluenesulfinate | 0.03 |
| Polyoxyethylene-p-monononylphenylether (average polymerization degree 10) | 0.2 |
| Disodium ethylenediaminetetraacetate | 0.05 |
| 1,2,4-triazole | 1.3 |
| 1,4-bis(1,2,4-triazole-1-yimethyl) piperazine | 0.75 |
| Water to make | 1.0 l |
| pH | 8.5 |

Density measurement was performed for each processed sample by using a green filter, and the sensitivity and the value of fog of each sample were obtained from the measurement result. Note that the sensitivity was represented by a relative value of the reciprocal of an exposure amount by which a density of fog +0.2 was given. The gradation was obtained from the slope of a line connecting a point at which density 1 was given and a point at which density 2 was given on the characteristic curve in which the reciprocal of an exposure amount was plotted on the abscissa. In addition, excess exposure was given to each sample to obtain the maximum color density. These results are summarized in Table 1 below.

EXAMPLE 2

<Preparation of emulsions 2A-1 and 2A-2>

While an aqueous solution prepared by dissolving 6 g of potassium bromide and 30 g of inert gelatin into 3.7 liter of distilled water was stirred sufficiently, an aqueous 14% potassium bromide solution and an aqueous 20% silver nitrate solution were added to the solution by a double-jet method at a constant flow rate over one minute at 55° C. and pBr 1.0 (in this addition, 2.4% of the total silver amount were consumed). An aqueous gelatin solution (17%, 300 cc) was added to the resultant solution, and the solution was stirred at 55° C. Thereafter, an aqueous 20% silver nitrate solution was added at a constant flow rate until the pBr reached 1.4 (in this addition, 5.0% of the total silver amount were consumed). Then, a 20% potassium bromide solution and an aqueous 33% silver nitrate solution were added by the double-jet method over 80 minutes. Note that when 57% of the total silver amount were consumed during this addition, a solution containing 8.3 g of potassium iodide was added while interrupting the addition of the solutions of silver nitrate and potassium bromide. During this addition, the temperature and the pBr were kept at 55° C. and 1.5°, respectively. The silver nitrate amount used in this emulsion was 425 g.

After being desalted by a regular flocculation method in such a manner as to adjust the salt concentration to 1/200, the resultant emulsion was added with the sensitizing dye S-1 and subjected to optimal gold-sulfur-selenium sensitization, yielding a mono-disperse tabular emulsion 2A-1 with an aspect ratio of 6.5 and an equivalent-sphere diameter of 0.8 μm.

TABLE 1

| Emulsion | Growth pAg | Crystal habit | Perfection ratio | Imidazole amount (mol/mol silver) | Sensitivity at 1/100" exposure | Sensitivity at 1/10000" exposure | Fog | γ at 1/100" exposure | Color density at 1/100" exposure | |
|---|---|---|---|---|---|---|---|---|---|---|
| 1A-1 | 9.0 | Octahedron | — | 0 | 100 | 100 | 0.14 | 0.5 | 2.6 | Comparative example |
| 1A-2 | " | " | — | 0.002 | 101 | 98 | 0.14 | 0.5 | 2.6 | " |
| 1B-1 | 8.0 | Tetradecahedron | — | 0 | 120 | 115 | 0.14 | 0.8 | 2.8 | " |
| 1B-2 | " | " | — | 0.002 | 120 | 118 | 0.14 | 0.8 | 2.8 | " |
| 1C-1 | 7.0 | " | 0.645 | 0 | 125 | 121 | 0.13 | 1.4 | 2.8 | " |
| 1C-2 | " | " | " | 0.002 | 123 | 120 | 0.14 | 1.4 | 2.8 | " |
| 1D-1 | 6.6 | Cube | 0.856 | 0 | 156 | 135 | 0.15 | 1.8 | 3.2 | " |
| 1D-2 | " | " | " | 0.002 | 155 | 141 | 0.14 | 1.8 | 3.2 | " |
| 1E-1 | 6.3 | Cube | 0.968 | 0 | 287 | 232 | 0.15 | 2.1 | 3.6 | Comparative example |
| 1E-2 | " | " | " | 0.0005 | 289 | 256 | 0.15 | 2.1 | 3.6 | Present invention |
| 1E-3 | " | " | " | 0.002 | 291 | 299 | 0.14 | 2.1 | 3.6 | " |
| 1F-1 | 5.7 | " | 0.997 | 0 | 298 | 241 | 0.15 | 2.2 | 3.6 | Comparative example |
| 1F-2 | " | " | " | 0.0005 | 300 | 295 | 0.14 | 2.2 | 3.6 | Present invention |
| 1F-3 | " | " | " | 0.002 | 300 | 301 | 0.14 | 2.2 | 3.6 | " |

As can been seen from Table 1, the higher the perfection ratio of cubes, the higher the sensitivity at 1/100" exposure, the harder the gradation, and the higher the color density of each emulsion containing no imidazole compound, but an increase in sensitivity at high illumination intensity was smaller than that in sensitivity at 1/100" exposure. However, a sensitivity at high illumination intensity significantly increased when the imidazole compound was added to substantially perfect cubes, although the addition of the imidazole compound brought about almost no change in sensitivity at high illumination intensity of octahedrons, tetradecahedrons, or cubes with a low perfection ratio. As for the addition amount dependency, cubes with a higher perfection ratio required a smaller amount of the imidazole compound.

An emulsion 2A-2 was prepared following the same procedures as for the emulsion 2A-1 except that 2 g of 1-vinylimidazole (exemplified compound IM-6) were added after the second stage addition. Note that the emulsions 2A-1 and 2A-2 were exactly the same in grain shape and grain size.

<Preparation of emulsions 2B-1 and 2B-2>

A cubic emulsion 2B-1 with an equivalent-sphere diameter of 0.8 μm was prepared following the same procedures as for the emulsion 1F-1 of Example 1 except that the grain size was controlled by decreasing the amount of the seed crystals 1. In addition, the amounts of the sensitizing dyes and the chemical sensitizers were also controlled in accordance with the surface area as needed. The desalting step was performed in a way which controlled the salt concentration to 1/200. The perfection ratio of this emulsion was 0.965.

An emulsion 2B-2 was prepared following the same procedures as for the emulsion 2B-1 except that 1.2 g of IM-6 were added before the addition of silver nitrate. The emulsions 2B-1 and 2B-2 had the same grain size, and the perfection ratio of the emulsion 2B-2 was 0.991.

The emulsions thus prepared were subjected to coating, exposure, development and measurement, following the same procedures as in Example 1, obtaining the sensitivity, the fog, the gradation, and the maximum color density of each resultant sample. The graininess of each sample was also evaluated. That is, after each sample was uniformly exposed with an exposure amount by which a density of fog +0.2 was given and developed in the same manner as described above, the RMS granularity of the sample was measured in accordance with the method described in "The Theory of Photographic Process," Macmillan, page 619. The results are summarized in Table 2 below.

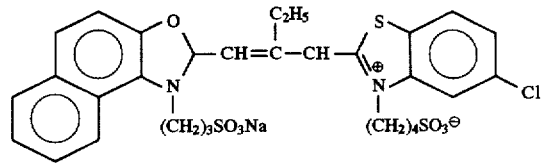

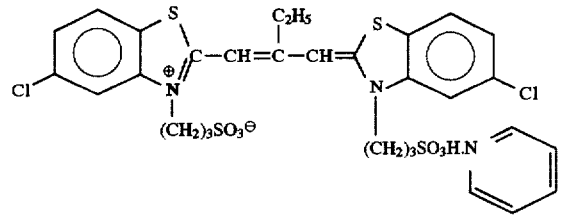

TABLE 2

| Emulsion | Grain shape | Addition of imidazole | Sensitivity at 1/100" exposure | Sensitivity at 1/10000" exposure | Granularity at 1/10000" exposure | Gradation at 1/10000" exposure | Maximum color density at 1/10000" exposure | |
|---|---|---|---|---|---|---|---|---|
| 2A-1 | Tabular grain | None | 100 | 100 | 100 | 1.5 | 2.8 | Comparative example |
| 2A-2 | " | Added | 98 | 102 | 100 | 1.5 | 2.8 | " |
| 2B-1 | Cubic grain | None | 124 | 96 | 95 | 1.9 | 3.3 | " |
| 2B-2 | " | Added | 144 | 146 | 95 | 2.1 | 3.4 | Present invention |

Table 2 reveals that the addition of the imidazole compound had no effect on tabular grains. The cubic emulsion containing no imidazole was higher than the tabular grains of the same grain size in sensitivity at 1/100" exposure but was lower than those in sensitivity at high illumination intensity. However, the sensitivity at high illumination intensity increased remarkably when the imidazole compound was added to the perfect cubic emulsion, yielding an emulsion having a higher sensitivity/graininess ratio, a harder gradation, and a higher color density than those of the tabular grains even at a high illumination intensity.

EXAMPLE 3

52 g of gelatin were dispersed in 1,000 cc of water at 60° C., and the pH was adjusted to 6.5. Then, 280 cc of an aqueous 0.2M silver nitrate solution and an aqueous potassium bromide solution were added over eight minutes. Subsequently, 500 cc of an aqueous 1.542M silver nitrate solution and an aqueous solution mixture of potassium bromide and potassium iodide, which contained 1.7 mol % of iodide, were added over 87 minutes while controlling the pAg to 6.5 (second stage). In this case, the aqueous silver nitrate solution was added while increasing the addition rate linearly with respect to time such that the final flow rate was three times the initial flow rate.

Subsequently, 1,030 cc of an aqueous 0.8M silver nitrate solution were added over 30 minutes while the pAg was kept at 6.3 by using an aqueous solution of halide (third stage). The halogen composition of the aqueous halide solution was 2.0 mol % of iodide and 98 mol % of bromide.

After the grain formation, sensitizing dye S-4, S-5, and S-6, indicated below were added in amounts of $7.4\times10^{-4}$ mol, $7.4\times10^{-4}$ mol, and $2.2\times10^{-5}$ mol, respectively, per mol of silver nitrate, and ripening was performed for 10 minutes.

-continued

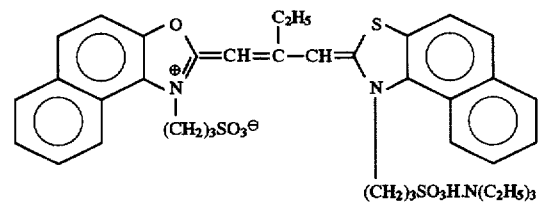

The resultant emulsion was then washed with water at 35° C. by a coagulation sedimentation process using a water-soluble polymer such that the salt concentration was adjusted to 1/180 while controlling the pAg to 7–8. 100 g of gelatin were added to the resultant emulsion, and the emulsion was redispersed under the conditions of pAg 7.5 and pH 6.4. As a result, a cubic emulsion was obtained having an equivalent-sphere diameter of 0.27 μm.

Subsequently, the resultant emulsion was heated up to 55° C. and added with potassium thiocyanate in an amount of $1\times10^{-3}$ mol per mol of silver. Thereafter, the pAg was controlled to 8.4, and chemical sensitization was optimally performed by using chloroauric acid, sodium thiosulfate, and dimethylselenourea, yielding an emulsion 3A-1. The perfection ratio after the chemical sensitization was found to be 0.971.

An emulsion 3A-2 was prepared following the same procedures as for the emulsion 3A-1 except that 1.5 g of BI-1 (benzimidazole) were added before the second stage addition. The equivalent-sphere diameter and the perfection ratio of this emulsion were 0.27 μm and 0.993, respectively.

An emulsion 3B-1 was prepared following the same procedures as for the emulsion 3A-1 except that $K_2IrCl_6$ was added in an amount of $1\times10^{-7}$ mol per mol of silver before the chemical sensitization.

An emulsion 3B-2 was prepared following the same procedures as for the emulsion 3B-1 except that 1.5 g of BI-1 were added before the second stage addition.

Each of the emulsions 3B-1 and 3B-2 was a perfect cubic emulsion with an equivalent-sphere diameter of 0.27 μm.

The emulsions thus prepared were subjected to coating, exposure, development, and measurement following the same procedures as in Example 1, obtaining the sensitivity and the gradation of each emulsion. The results are summarized in Table 3 below.

TABLE 3

| Emulsion | Addition of iridium | Imidazole amount (mol/mol silver) | Sensitivity at 1/100" exposure | Sensitivity at 1/10000" exposure | Gradation at 1/10000" exposure | |
|---|---|---|---|---|---|---|
| 3A-1 | None | 0 | 100 | 100 | 1.8 | Comparative example |
| 3A-2 | " | 0.0005 | 101 | 124 | 2.0 | Present invention |
| 3A-3 | " | 0.0010 | 101 | 126 | 2.0 | " |
| 3B-1 | Added | 0 | 87 | 110 | 2.1 | Comparative example |
| 3B-2 | " | 0.0005 | 98 | 141 | 2.2 | Present invention |
| 3B-3 | " | 0.0010 | 98 | 144 | 2.2 | " |

As is apparent from Table 3, when iridium was added without adding any imidazole compound, the gradation became somewhat harder and the sensitivity more or less increased at high-intensity exposure, but the sensitivity at 1/100" exposure decreased. However, the use of an iridium compound increased the sensitivity at 1/10000" exposure without impairing the sensitivity at 1/100" exposure. In addition, the imidazole compound was effective even in the emulsion containing the iridium compound. This eliminated the drawback of a decrease in sensitivity at 1/100" exposure when the iridium compound was used singly, achieving a higher sensitivity at high illumination intensity.

EXAMPLE 4

<Preparation of emulsion 4A>

A substantially perfect cubic emulsion 4A with an equivalent-sphere diameter of 0.5 μm was prepared following the same procedures as for the emulsion 1E-1 of Example 1. The perfection ratio of this emulsion was found to be 0.968.

Emulsions 4B to 4F were prepared following the same procedures as for the emulsion 4A except that imidazole compounds described below were added before the first stage addition of silver nitrate.

<Preparation of emulsion 4B>

The emulsion 4B was prepared by adding 3.2 g of unsubstituted imidazole (IM-1).

The resultant emulsion was a cubic emulsion with an equivalent-sphere diameter of 0.5 μm and a perfection ratio of 0.970.

21 Preparation of emulsion 4C>

The emulsion 4C was prepared by adding 1.5 g of 1-vinylimidazole (IM-6).

The resultant emulsion was a cubic emulsion with an equivalent-sphere diameter of 0.5 μm and a perfection ratio of 0.975.

<Preparation of emulsion 4D>

The emulsion 4D was prepared by adding 1.2 g of benzimidazole (BI-1).

The resultant emulsion was a cubic emulsion with an equivalent-sphere diameter of 0.5 μm and a perfection ratio of 0.991.

<Preparation of emulsion 4E>

The emulsion 4E was prepared by adding 1.7 g of 1-methylimidazole (IM-2).

The resultant emulsion was a cubic emulsion with an equivalent-sphere diameter of 0.5 μm and a perfection ratio of 0.982.

<Preparation of emulsion 4F>

The emulsion 4F was prepared by adding 2.0 g of an imidazole-containing polymer P-2.

The resultant emulsion was a cubic emulsion with an equivalent-sphere diameter of 0.5 μm and a perfection ratio of 0.997.

<Preparation of emulsion 4G>

The emulsion 4G was prepared by adding 3.0 g of an imidazole-containing polymer P-5.

The resultant emulsion was a cubic emulsion with an equivalent-sphere diameter of 0.5 μm and a perfection ratio of 0.986.

Note that the addition amount of each imidazole compound in the emulsions 4B to 4G was determined such that the highest sensitivity at 1/10000" exposure was obtained without decreasing the sensitivity at 1/100" exposure.

The emulsions thus prepared were subjected to coating, exposure, development, and measurement following the same procedures as in Example 1, obtaining the sensitivity and the gradation of each emulsion. The results are summarized in Table 4 below.

TABLE 4

| Emulsion | Type of imidazole | Perfection ratio | Sensitivity at 1/100" exposure | Sensitivity at 1/10000" exposure | |
|---|---|---|---|---|---|
| 4A | None | 0.968 | 100 | 100 | Comparative example |
| 4B | Imidazole | 0.970 | 98 | 130 | Present invention |
| 4C | 1-vinylimidazole | 0.975 | 102 | 141 | " |
| 4D | Benzimidazole | 0.991 | 102 | 135 | " |
| 4E | 1-methylimidazole | 0.982 | 101 | 131 | " |
| 4F | P-2 (polymer) | 0.997 | 105 | 130 | " |
| 4G | P-5 (polymer) | 0.986 | 102 | 128 | " |

Table 4 reveals that the high-intensity sensitivity increased significantly when the imidazole compound was combined with the perfect cubic emulsion regardless of the type of a substituent of the imidazole compound or regardless of whether the imidazole compound is a monomer or a polymer.

EXAMPLE 5

<Preparation of emulsion 5A>

A pure silver bromide cubic emulsion was prepared following the same procedures as for the emulsion N of Example 3 in JP-A-54-100717 except that washing, desalting, redispersing, spectral sensitization, and chemical sensitization were performed following the same procedures as in Example 1 of the present invention. The equivalent-sphere diameter of this emulsion was 1.3 μm (J-A-54-100717 describes that the equivalentsphere diameter of the emulsion N was 1.7 μm). The perfection ratio of the emulsion was found to be 0.753.

<Preparation of emulsion 5B>

A pure silver bromide cubic emulsion with an equivalent-sphere diameter of 1.3 μm and a perfection ratio of 0.760 was prepared by growing the seed emulsion prepared in Example 1 by a repeating controlled double-jet method while controlling the pAg to 6.6. Washing, desalting, redispersing, spectral sensitization, and chemical sensitization were performed following the same procedures as in Example 1 of the present invention.

<Preparation of emulsion 5C>

An emulsion 5C was prepared following the same procedures as for the emulsion 5B except that growth was performed such that unsubstituted imidazole (I-1) was constantly present in an amount of $1\times10^{-2}$ mol per mol of silver after the growth. In this case, the preparation was controlled such that the unsubstituted imidazole was present in an amount of $1\times10^{-4}$ per mol of silver after the final grains were washed with water. Washing, desalting, redispersion, spectral sensitization, and chemical sensitization were performed following the same procedures as in Example 1 of the present invention, thereby preparing the pure silver bromide cubic emulsion 5C with an equivalent-sphere diameter of 1.3 μm and a perfection ratio of 0.972.

<Preparation of emulsion 5D>

An emulsion 5D was prepared following the same procedures as for the emulsion 5B except that the pAg during growth was controlled to 5.6 and unsubstituted imidazole (I-1) was added in an amount of $1\times10^{-4}$ mol per mol of silver before chemical sensitization. As a result, a pure silver bromide cubic emulsion was obtained, having an equivalent-sphere diameter of 1.3 μm and a perfection ratio of 0.971.

The emulsions thus prepared were subjected to coating, exposure, development, and measurement following the same procedures as in Example 1, obtaining the sensitivity and the gradation of each emulsion. The results are summarized in Table 5 below.

TABLE 5

| Emulsion | Addition timing of imidazole | Perfection ratio | Sensitivity at 1/100" exposure | Sensitivity at 1/10000" exposure | |
|---|---|---|---|---|---|
| 5A | Before grain formation | 0.753 | 100 | 100 | Comparative example |
| 5B | No addition | 0.760 | 105 | 98 | " |
| 5C | During grain growth | 0.972 | 155 | 215 | Present invention |
| 5D | Before chemical sensitization | 0.971 | 143 | 197 | " |

As can be seen from Table 5, although the emulsion of J-A-54-100717 contained the imidazole compound, its sensitivity at high illumination intensity was low, at the same level as the emulsion 5B containing no imidazole, because of the low perfection ratio of the cubes. In contrast, each emulsion prepared by adding the imidazole compound to the substantially perfect cubes of the present invention had a very high sensitivity at high illumination intensity regardless of the addition timing of the imidazole compound.

EXAMPLE 6

The effect of the invention in a silver halide light-sensitive material having a plurality of emulsion layers will be described below.

Multiple layers having the compositions presented below were coated on a subbed triacetylcellulose film support to make a sample 6-1 as a multilayered color photographing material.

(Compositions of layers)

The main materials used in the individual layers are classified as follows. ExC: Cyan coupler UV : Ultraviolet absorbent ExM: Magenta coupler HBS: High-boiling organic solvent ExY: Yellow coupler H : Gelatin hardener ExS: Sensitizing dye The number corresponding to each component indicates the coating amount in units of g/m$^2$. The coating amount of a silver halide is represented by the amount of silver. The coating amount of each sensitizing dye is represented in units of moles per mole of silver halide in the same layer.

(Samples 6-1)

| | | |
|---|---|---|
| 1st layer (Antihalation layer) | | |
| Black colloidal silver | silver | 0.18 |
| Gelatin | | 1.40 |
| ExM-1 | | 0.18 |
| ExF-1 | | $2.0\times10^{-3}$ |
| HBS-1 | | 0.20 |
| 2nd layer (Interlayer) | | |
| Emulsion G | silver | 0.065 |
| 2,5-di-t-pentadecylhydroquinone | | 0.18 |
| ExC-2 | | 0.020 |
| UV-1 | | 0.060 |
| UV-2 | | 0.080 |
| UV-3 | | 0.10 |
| HBS-1 | | 0.10 |
| HBS-2 | | 0.020 |
| Gelatin | | 1.04 |

-continued

| | | |
|---|---|---|
| 3rd layer (Low-speed red-sensitive emulsion layer) | | |
| Emulsion A | silver | 0.25 |
| Emulsion C | silver | 0.25 |
| ExS-1 | | $4.5 \times 10^{-4}$ |
| ExS-2 | | $1.5 \times 10^{-5}$ |
| ExS-3 | | $4.5 \times 10^{-4}$ |
| ExC-1 | | 0.17 |
| ExC-3 | | 0.030 |
| ExC-4 | | 0.10 |
| ExC-5 | | 0.005 |
| ExC-7 | | 0.005 |
| ExC-8 | | 0.020 |
| Cpd-2 | | 0.025 |
| HBS-1 | | 0.10 |
| Gelatin | | 0.87 |
| 4th layer (Medium-speed red-sensitive emulsion layer) | | |
| Emulsion D | silver | 0.80 |
| ExS-1 | | $3.0 \times 10^{-4}$ |
| ExS-2 | | $1.2 \times 10^{-5}$ |
| ExS-3 | | $4.0 \times 10^{-4}$ |
| ExC-1 | | 0.15 |
| ExC-2 | | 0.060 |
| ExC-4 | | 0.11 |
| ExC-7 | | 0.0010 |
| ExC-8 | | 0.025 |
| Cpd-2 | | 0.023 |
| HBS-1 | | 0.10 |
| Gelatin | | 0.75 |
| 5th layer (High-speed red-sensitive emulsion layer) | | |
| Emulsion E | silver | 1.40 |
| ExS-1 | | $2.0 \times 10^{-4}$ |
| ExS-2 | | $1.0 \times 10^{-5}$ |
| ExS-3 | | $3.0 \times 10^{-4}$ |
| ExC-1 | | 0.095 |
| ExC-3 | | 0.040 |
| ExC-6 | | 0.020 |
| ExC-8 | | 0.007 |
| Cpd-2 | | 0.050 |
| HBS-1 | | 0.22 |
| HBS-2 | | 0.10 |
| Gelatin | | 1.20 |
| 6th layer (Interlayer) | | |
| Cpd-1 | | 0.10 |
| HBS-1 | | 0.50 |
| Gelatin | | 1.10 |
| 7th layer (Low-speed green-sensitive emulsion layer) | | |
| Emulsion A | silver | 0.2 |
| Emulsion B | silver | 0.2 |
| ExS-4 | | $4.0 \times 10^{-5}$ |
| EXS-5 | | $1.8 \times 10^{-4}$ |
| ExS-6 | | $6.5 \times 10^{-4}$ |
| ExM-1 | | 0.010 |
| ExM-2 | | 0.33 |
| ExM-3 | | 0.086 |
| ExY-1 | | 0.015 |
| HBS-1 | | 0.30 |
| HBS-3 | | 0.010 |
| Gelatin | | 0.73 |
| 8th layer (Medium-speed green-sensitive emulsion layer) | | |
| Emulsion D | silver | 0.80 |
| ExS-4 | | $2.0 \times 10^{-5}$ |
| ExS-5 | | $1.4 \times 10^{-4}$ |
| ExS-6 | | $5.4 \times 10^{-4}$ |
| ExM-2 | | 0.16 |
| ExM-3 | | 0.045 |

-continued

| | | |
|---|---|---|
| ExY-1 | | 0.01 |
| ExY-5 | | 0.030 |
| HBS-1 | | 0.16 |
| HBS-3 | | $8.0 \times 10^{-3}$ |
| Gelatin | | 0.90 |
| 9th layer (High-speed green-sensitive emulsion layer) | | |
| Emulsion E | silver | 1.25 |
| ExS-4 | | $3.7 \times 10^{-5}$ |
| ExS-5 | | $8.1 \times 10^{-5}$ |
| ExS-6 | | $3.2 \times 10^{-4}$ |
| ExC-1 | | 0.010 |
| ExM-1 | | 0.015 |
| ExM-4 | | 0.040 |
| ExM-5 | | 0.019 |
| Cpd-3 | | 0.020 |
| HBS-1 | | 0.25 |
| HBS-2 | | 0.10 |
| Gelatin | | 1.20 |
| 10th layer (Yellow filter layer) | | |
| Yellow colloidal silver | silver | 0.010 |
| Cpd-1 | | 0.16 |
| HBS-1 | | 0.60 |
| Gelatin | | 0.60 |
| 11th layer (Low-speed blue-sensitive emulsion layer) | | |
| Emulsion C | silver | 0.25 |
| Emulsion D | silver | 0.40 |
| ExS-7 | | $8.0 \times 10^{-4}$ |
| ExY-1 | | 0.030 |
| ExY-2 | | 0.55 |
| ExY-3 | | 0.25 |
| ExY-4 | | 0.020 |
| ExC-7 | | 0.01 |
| HBS-1 | | 0.35 |
| Gelatin | | 1.30 |
| 12th layer (High-speed blue-sensitive emulsion layer) | | |
| Emulsion F | silver | 1.38 |
| ExS-7 | | $3.0 \times 10^{-4}$ |
| ExY-2 | | 0.10 |
| ExY-3 | | 0.10 |
| HBS-1 | | 0.070 |
| Gelatin | | 0.86 |
| 13th layer (1st protective layer) | | |
| Emulsion G | silver | 0.20 |
| UV-4 | | 0.11 |
| UV-5 | | 0.17 |
| HBS-1 | | $5.0 \times 10^{-2}$ |
| Gelatin | | 1.00 |
| 14th layer (2nd protective layer) | | |
| H-1 | | 0.40 |
| B-1 (diameter 1.7 μm) | | $5.0 \times 10^{-2}$ |
| B-2 (diameter 1.7 μm) | | 0.10 |
| B-3 | | 0.10 |
| Sx-i | | 0.20 |
| Gelatin | | 1.20 |

In addition to the above components, to improve storage stability, processability, a resistance to pressure, antiseptic and mildewproofing properties, antistatic properties, and coating properties, the individual layers contained W-1 to W-3, B-4 to B-6, F-1 to F-17, iron salt, lead salt, gold salt, platinum salt, iridium salt, and rhodium salt.

The emulsions A–G used are shown in Table 6 below.

TABLE 6

| Emulsion No. | Average AgI content (%) | Average grain size (μm) | Variation coefficient (%) relating to grain size | Diameter/ thickness ratio | Silver amount ratio Core/inter-mediate shell | Silver amount ratio AgI content | Grain structure/shape |
|---|---|---|---|---|---|---|---|
| Emulsion A | 2.0 | 0.55 | 25 | 7 | | | Uniform structure tabular grain |
| Emulsion B | 4.5 | 0.65 | 25 | 6 | 12/59/29 | 0/11/8 | Triple structure tabular grain |
| Emulsion C | 3.0 | 0.45 | 25 | 7 | 10/60/30 | 0/1/8 | Triple structure tabular grain |
| Emulsion D | 2.8 | 0.80 | 18 | 6 | 14/56/30 | 0.2/1/7.5 | Triple structure tabular grain |
| Emulsion E | 2.3 | 1.10 | 16 | 6 | 6/64/30 | 0.2/1/5.5 | Triple structure tabular grain |
| Emulsion F | 13.6 | 1.75 | 26 | 3 | 1/2 | 41/0 | Double structure tabular grain |
| Emulsion G | 1.0 | 0.07 | 15 | 1 | | | Uniform structure fine grain |

In Table 6, (1) The emulsions A to F were subjected to reduction sensitization during grain preparation by using thiourea dioxide and thiosulfonic acid in accordance with the Examples in JP-A-2-191938.

(2) The emulsions A to F were subjected to gold sensitization, sulfur sensitization, and selenium sensitization in the presence of the spectral sensitizing dyes described in the individual light-sensitive layers and sodium thiocyanate in accordance with the Examples in JP-A-3-237450.

(3) In the preparation of tabular grains, low-molecular weight gelatin was used in accordance with the Examples in JP-A-1-158426.

(4) Dislocation lines as described in JP-A-3-237450 were observed in tabular grains by a highyoltage electron microscope.

The substances used are indicated below.

ExC-1

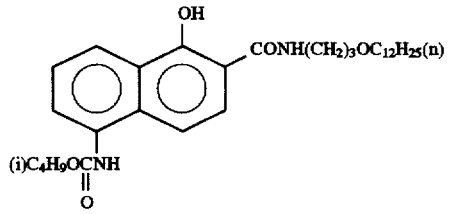

ExC-2

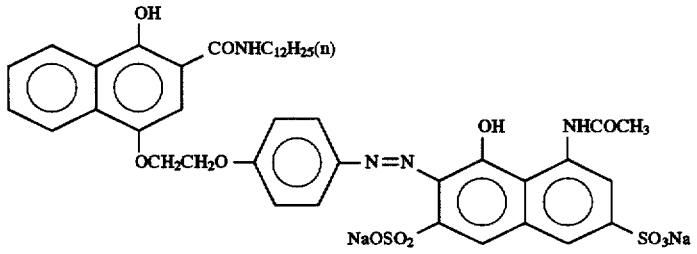

ExC-3

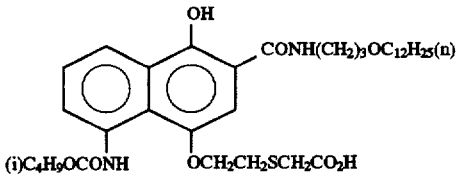

-continued
ExC-4
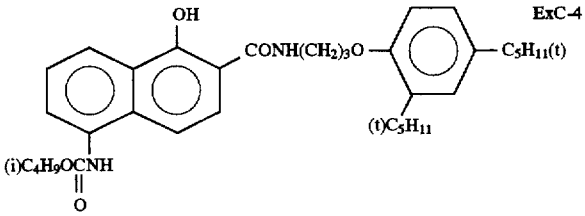
ExC-5
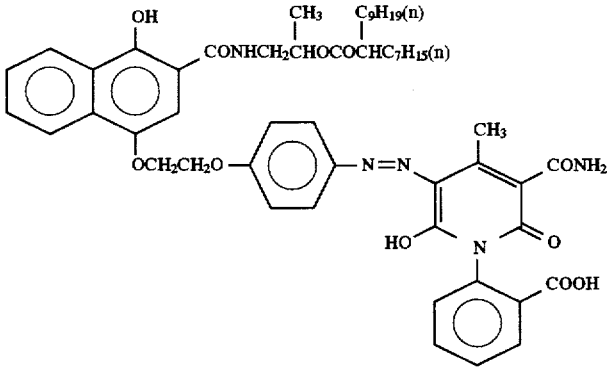
ExC-6
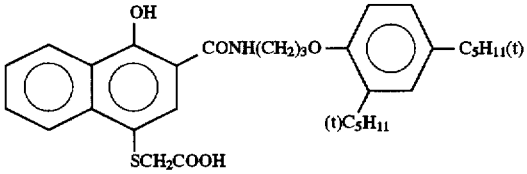
ExC-7
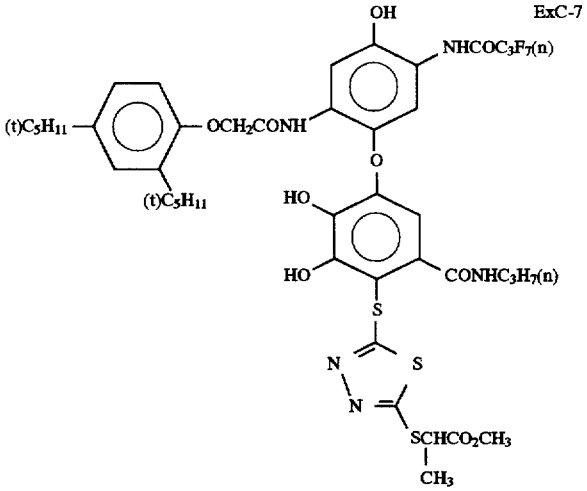
ExC-8
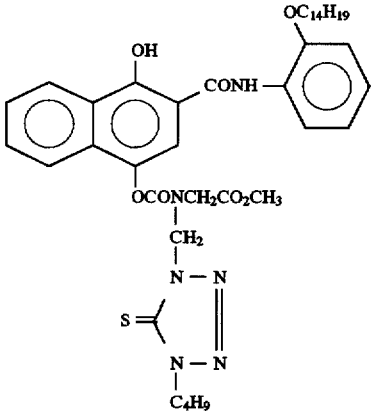

-continued
ExM-1
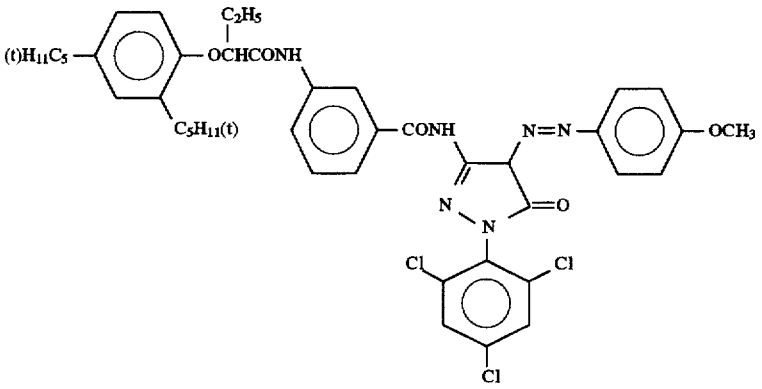
ExM-2
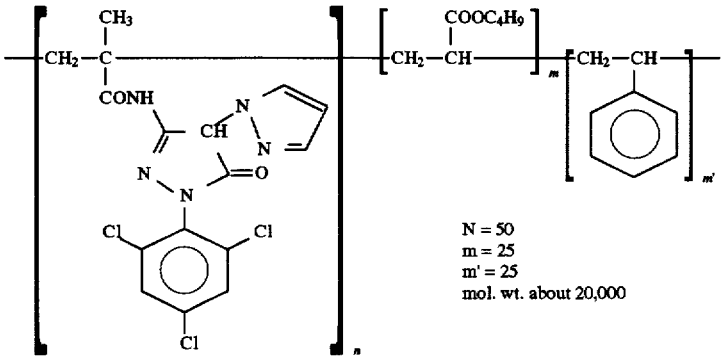
N = 50
m = 25
m' = 25
mol. wt. about 20,000
ExM-3
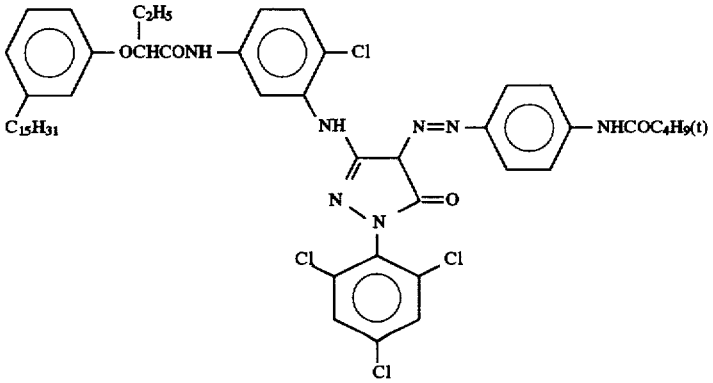
ExM-4
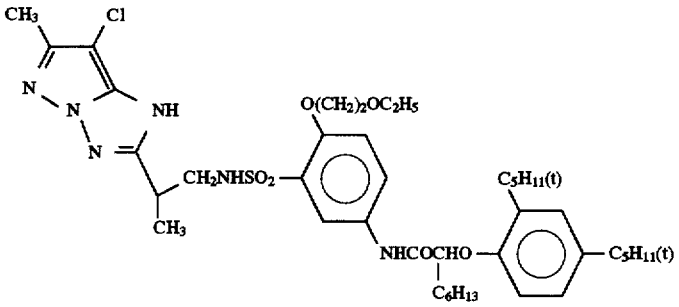

-continued
ExM-5
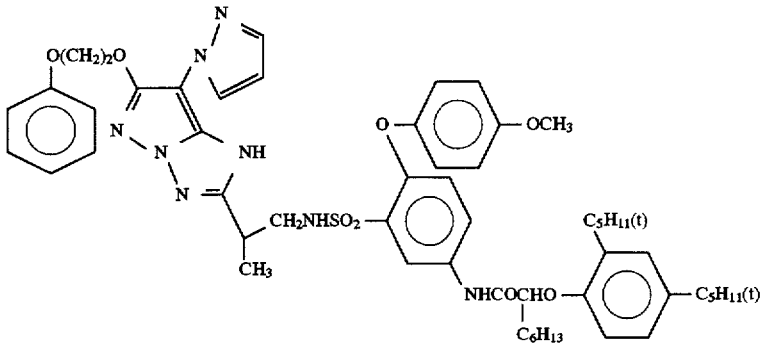
ExY-1
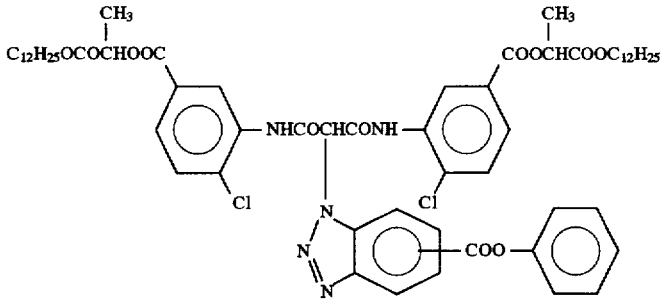
ExY-2
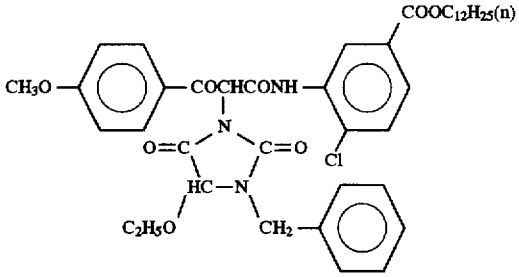
ExY-3
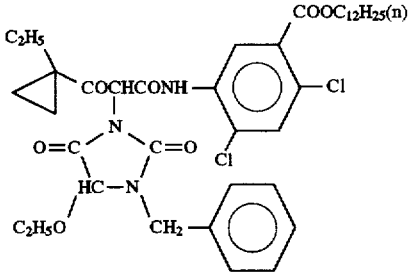
ExY-4
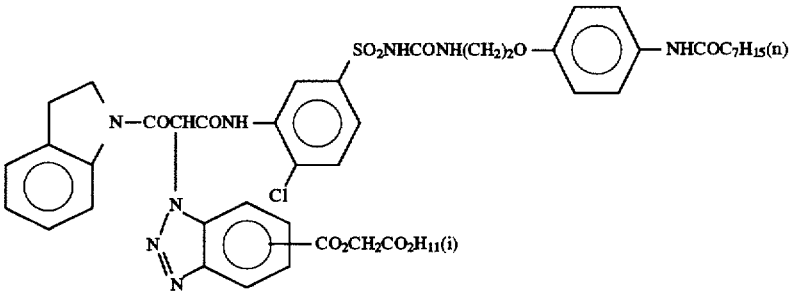
ExY-5
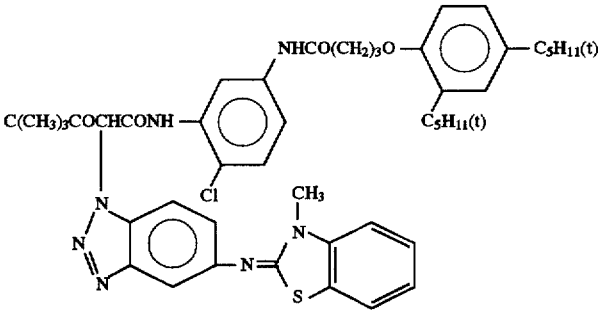

-continued
ExF-1
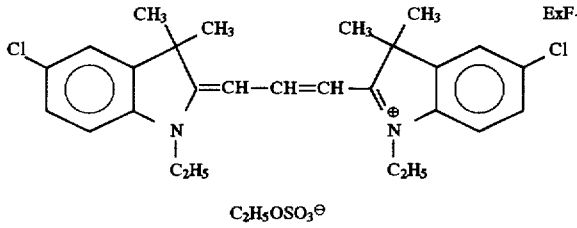
Cpd-1
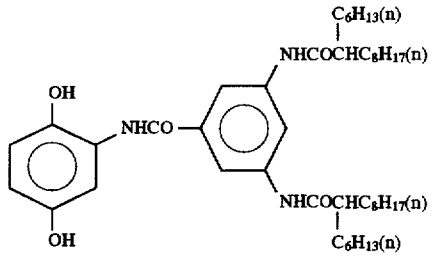
Cpd-2
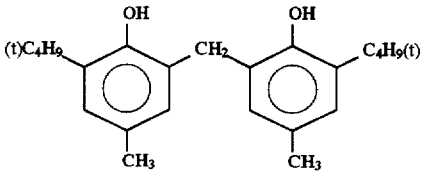
Cpd-3
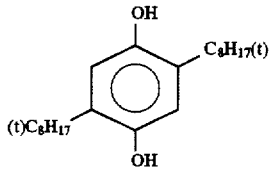
UV-1
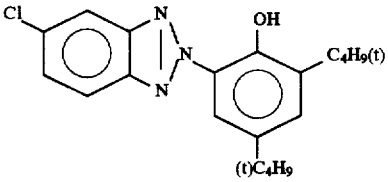
UV-2
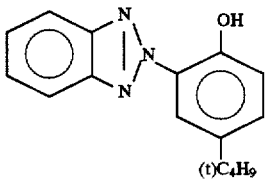
UV-3
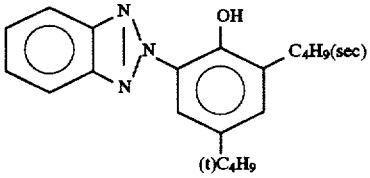
UV-4
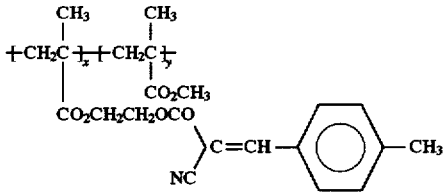
x:y = 70:30 (wt%)
UV-5
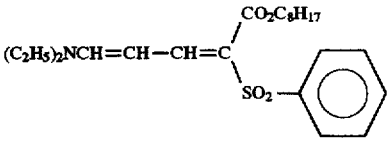
Tricresyl phosphate HBS-1
Di-n-butyl phthalate HBS-2
HBS-3
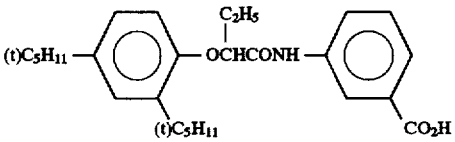
ExS-1
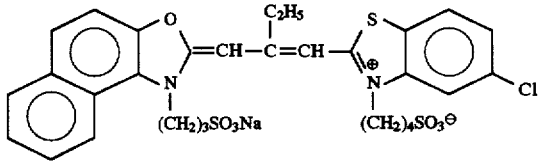
ExS-2
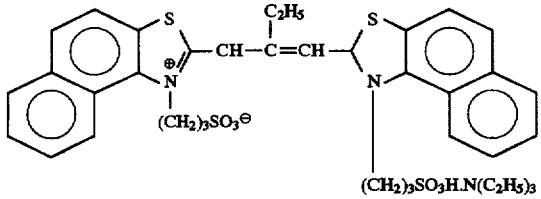

-continued
ExS-3
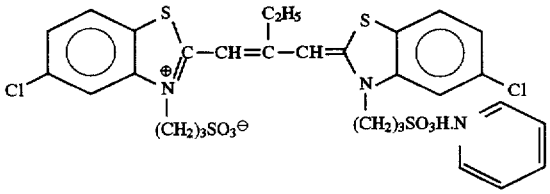
ExS-4
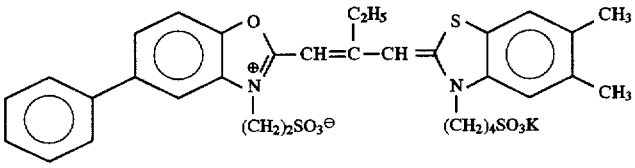
ExS-5
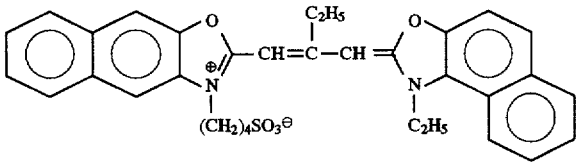
ExS-6
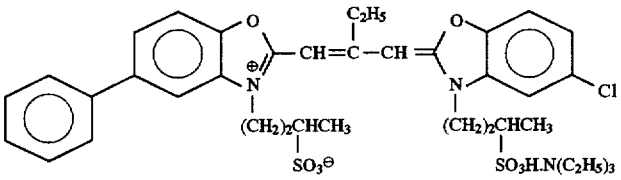
ExS-7
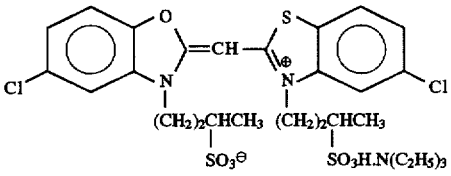
Sx-1
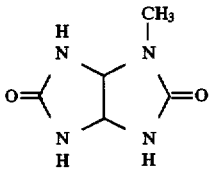
H-1
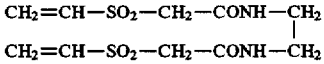
B-1
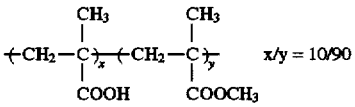
x/y = 10/90
B-2
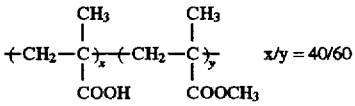
x/y = 40/60
B-3
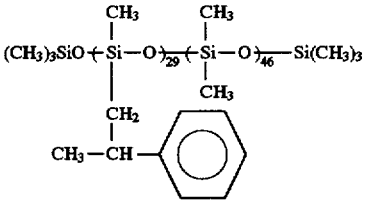

-continued
B-4
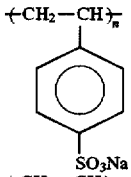
B-5
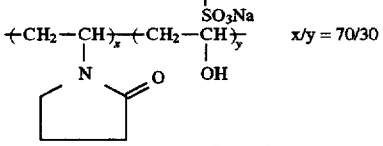
x/y = 70/30
B-6
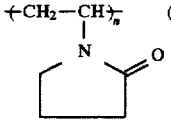
(mol. wt. about 10,000)
W-1
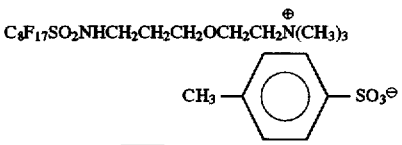
W-2
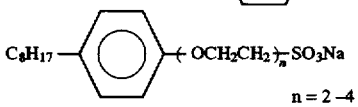
n = 2 –4
W-3
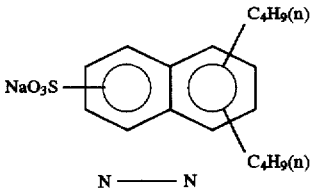
F-1
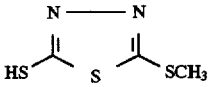
F-2
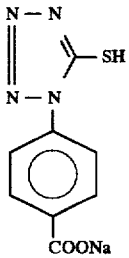
F-3
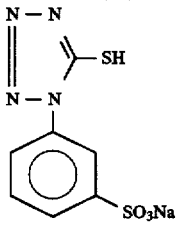
F-4
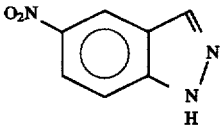
F-5
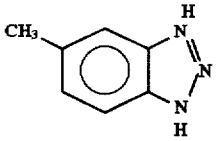

-continued
F-6
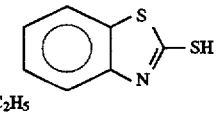
F-7
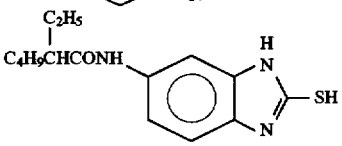
F-8
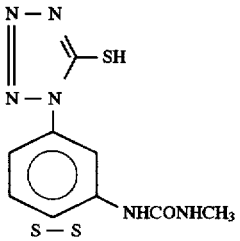
F-9
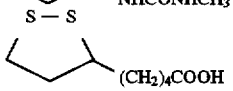
F-10
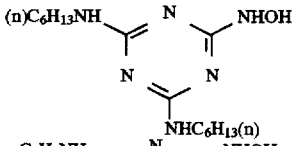
F-11
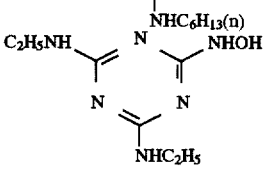
F-12
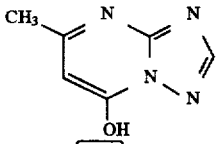
F-13
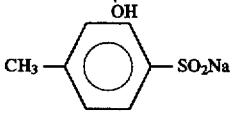
F-14
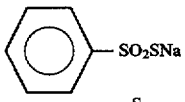
F-15
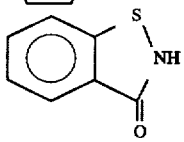
F-16
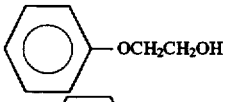
F-17
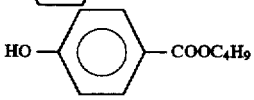

TABLE 7

| Emulsion | Average grain size (μm) | Use of benzimidazole | Perfection ratio | |
|---|---|---|---|---|
| 6A | 0.25 | Used | 0.998 | Present invention |
| 6B | 0.45 | Used | 0.997 | " |
| 6C | 0.25 | None | 0.998 | Comparative example |
| 6D | 0.45 | None | 0.997 | " |

A sample 6-2 was prepared by replacing the emulsions A and B in the seventh layer with the emulsions 6A and 6B, respectively.

A sample 6-3 was prepared by changing the coating amount of each of the emulsions 6A and 6B of the sample 6-2 to 0.14. A sample 6-4 was prepared by replacing the emulsions 6A and 6B in the seventh layer of the sample 6-3 with the emulsions 6C and 6D, respectively. A sample 6-5 was prepared by adding 0.01 g/m$^2$ of vinylimidazole (IM-6) to the sixth layer of the sample 6-4.

These samples were left to stand at a temperature of 40° C. and a relative humidity of 70% for 14 hours. Thereafter, each sample was exposed to white light for 1/100 second and subjected to color development following the same procedures as in Example 1 except that the color development time was 3 minutes and 15 seconds.

Density measurement was performed through a green filter, and the relative sensitivity of each sample was obtained by the reciprocal of an exposure amount by which a density of 2.5 was given. In addition, after each sample was uniformly exposed with an exposure amount by which a density of 2.5 was given, and developed, the granularity of the sample was measured in accordance with the method described in "The Theory of Photographic Process," Macmillan, page 619.

The results are summarized in Table 8 below.

TABLE 8

| Sample | 7th layer Emulsion used | 7th layer Silver coating amount | Addition of imidazole to 7th layer | Addition of imidazole to 6th layer | Sensitivity at 1/100" exposure | Sensitivity at 1/10000" exposure | Granularity at 1/10000" exposure | |
|---|---|---|---|---|---|---|---|---|
| 6-1 | A/B | 0.20/0.20 | None | None | 100 | 100 | 100 | Comparative example |
| 6-2 | 6A/6B | 0.20/0.20 | Added | None | 147 | 165 | 67 | Present invention |
| 6-3 | 6A/6B | 0.14/0.14 | Added | None | 103 | 121 | 97 | Present invention |
| 6-4 | 6C/6D | 0.14/0.14 | None | None | 101 | 87 | 96 | Comparative example |
| 6-5 | 6C/6D | 0.14/0.14 | None | Added | 102 | 115 | 97 | Present invention |

As shown in Table 8, each silver halide photographic light-sensitive material formed by adding the imidazole compound to the cubic emulsion with a high perfection ratio according to the present invention could achieve a high sensitivity at 1/100" exposure and a high sensitivity at high illumination intensity while improving graininess, compared to the conventional tabular emulsions. In addition, the graininess almost remained the same even after silver saving of 70%, and this made it possible to provide a silver halide photographic light-sensitive material with a high sensitivity at high illumination intensity. Table 8 also reveals that the sensitivity at high illumination intensity could also be enhanced by adding the imidazole compound to a layer other than a silver halide emulsion layer in a multilayered light-sensitive material.

What is claimed is:

1. A silver halide photographic light-sensitive material comprising at least one silver halide emulsion layer on a support, and containing an imidazole compound, said silver halide emulsion layer containing silver halide grains, wherein all of the silver halide grains in the silver halide emulsion layer are substantially perfect cubic silver halide grains having a perfection ratio of 0.96 or more, wherein said substantially perfect cubic silver halide grains have a silver chloride content of not more than 3 mol % and a silver iodide content of not less than 0.5 mol %, and are chemically sensitized, and also are spectrally sensitized with a sensitizing dye.

2. The light-sensitive material according to claim 1, wherein said imidazole compound is represented by Formula I below:

Formula I

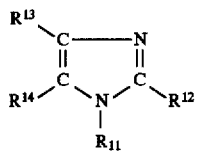

where $R^{11}$, $R^{12}$, $R^{13}$, and $R^{14}$ may be the same or different and each represents a hydrogen atom, or an alkyl group, an alkenyl group, an aryl group or an aralkyl group, each of which is either unsubstituted or substituted with at least one member selected from the group consisting of hydroxyl, cyano, alkoxy, and free or esterified carboxyl or sulfo.

3. The light-sensitive material according to claim 1, wherein said imidazole compound is represented by Formula II below:

Formula II

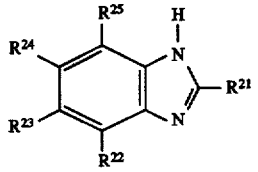

where $R^{21}$ represents a hydrogen atom, a halogen atom, an alkyl group, an alkenyl group, an aryl group, or a heterocyclic group; and $R^{22}$ to $R^{25}$ may be the same or different and each represents a hydrogen atom, a halogen atom, a hydroxy group, an amino group, a nitro group, a cyano group, a carboxy group or salt thereof, a sulfo group or salt thereof, an alkyl group, an alkenyl group, an aryl group, or an $R^{26}$—D— group wherein $R^{26}$ represents an alkyl group or an aryl group and D represents —$SO_2$—, —O—, —S—, —CO—, —COO—, —OCO—, —CONH—, —NHCO—, —$SO_2$NH—, or —$NHSO_2$—.

4. The light-sensitive material according to claim 1, wherein said imidazole compound is represented by Formula III below:

$$\text{Formula III}$$

where A represents a repeating unit derived from an ethylenically unsaturated monomer having at least one imidazole group, B represents a repeating unit derived from a monomer other than A, and each of X and Y represents a percentage by weight of each component, X representing 0.1 to 100, and Y representing 0 to 99.9.

5. The light-sensitive material according to claim 1, wherein said silver halide emulsion contains an iridium compound.

6. The light-sensitive material according to claim 2, wherein said imidazole compound of Formula I was present during grain formation.

7. The light-sensitive material according to claim 3, wherein said imidazole compound of Formula II was present during grain formation.

8. The light-sensitive material according to claim 4, wherein said imidazole compound of Formula III was present during grain formation.

9. The silver halide photographic light-sensitive material according to claim 1, wherein said substantially perfect cubic silver halide grains have a perfection ratio of 0.99 or more.

* * * * *